US006771281B2

(12) United States Patent
Takagi

(10) Patent No.: US 6,771,281 B2
(45) **Date of Patent: *Aug. 3, 2004**

(54) MODULATION CIRCUIT AND IMAGE DISPLAY USING THE SAME

(75) Inventor: Yuichi Takagi, Kanagawa (JP)

(73) Assignee: Sony Corporation (JP)

( * ) Notice: Subject to any disclaimer, the term of this patent is extended or adjusted under 35 U.S.C. 154(b) by 212 days.

This patent is subject to a terminal disclaimer.

(21) Appl. No.: 09/843,847

(22) Filed: Apr. 30, 2001

(65) Prior Publication Data

US 2002/0000982 A1 Jan. 3, 2002

(30) Foreign Application Priority Data

May 1, 2000 (JP) ..... P2000-137159

(51) Int. Cl.[7] ..... G09G 5/10; G09G 3/32
(52) U.S. Cl. ..... 345/690; 345/82
(58) Field of Search ..... 345/46, 82, 83, 345/204, 205, 206, 208, 210, 213, 214, 690, 691, 692, 693; 332/109

(56) References Cited

U.S. PATENT DOCUMENTS 4,021,607 A * 5/1977 Amano ..... 345/691
4,353,062 A * 10/1982 Lorteije et al. ..... 345/692
4,649,432 A * 3/1987 Watanabe et al. ..... 345/691
4,897,639 A * 1/1990 Kanayama ..... 345/82
5,250,939 A * 10/1993 Takanashi et al. ..... 345/204
5,633,655 A * 5/1997 Hara ..... 345/698
6,310,589 B1 * 10/2001 Nishigaki et al. ..... 345/82
6,472,946 B2 * 10/2002 Takagi ..... 332/109
6,476,779 B1 * 11/2002 Yano et al. ..... 345/83
6,646,654 B2 * 11/2003 Takagi ..... 345/690

* cited by examiner

*Primary Examiner*—Chanh Nguyen
*Assistant Examiner*—Paul A. Bell
(74) *Attorney, Agent, or Firm*—Rader, Fishman & Grauer PLLC; Ronald P. Kananen

(57) ABSTRACT

A modulation circuit for outputting a pulse signal modulated in accordance with the value of input data by a predetermined period, comprising a clock generation circuit for generating and outputting a first clock pulse changing in frequency by the predetermined period, a clock counting circuit for receiving the first clock pulse, counting the first clock pulse from a predetermined initial value in an initial stage of the predetermined period, and outputting a clock count and a pulse signal output circuit for comparing magnitudes of the clock count and the value of the input data and inverting a level of the pulse signal in the vicinity of a time when the magnitudes of the clock count and the value of the input data invert.

15 Claims, 14 Drawing Sheets

MODULATION CIRCUIT AND IMAGE DISPLAY USING THE SAME

BACKGROUND OF THE INVENTION

1. Field of the Invention

The present invention relates to a modulation circuit for outputting a pulse signal modulated in accordance with a value of input data by a predetermined period and an image display using the same, more particularly relates to a modulation circuit of a drive signal of a light emitting diode (LED) and an image display using the same.

2. Description of the Related Art

Since the invention of the blue LED, LED color displays that use LEDs to form pictures by pixels emitting the three primary colors have been widely and generally fabricated. An LED is highly durable can be used semipermanently, so is optimal for long-term use outdoors. Therefore, LEDs have been extensively used for large-scale displays in stadiums and event sites and for information display panels or advertisements on sides of buildings and inside railway stations. In recent years, along with the increasing luminance and lower prices of blue LEDs, such LED color displays have been spreading rapidly.

FIG. 1 is a view of a drive circuit of an LED forming a pixel of an LED display.

In FIG. 1, reference numeral 100 indicates a drive circuit and 200 an LED. In addition, Spx represents a video signal supplied to an individual pixel, and Id a current flowing through the LED 200, respectively.

The drive circuit 100 outputs a current according to the video signal Spx to the LED 200, while the LED 200 emits light according to the supplied current. An LED display is comprised of exactly the same number of circuits consisting of the drive circuits 100 and LEDs shown in FIG. 1 as that of the pixels. By making the LEDS of the pixels emit light with luminances according to the video signals Spx supplied to the pixels, a person viewing the screen can recognize a picture. The video signal Spx supplied to each pixel is generally input to the drive circuit 100 as a digital value of a certain number of bits.

FIG. 2 is a view of the waveform of the current flowing through the LED 200 in FIG. 1.

In FIG. 2, the ordinate indicates the current flowing through the LED 200 by a relative value, while the abscissa indicates time by a relative value. In addition, Ipulse indicates the peak value of the waveform of the pulse-shaped current flowing through the LED, tw the time width of the pulse portion, and T the period of the waveform, As shown in FIG. 2, the current flowing through the LED forming a pixel of an LED display has a periodic pulse-like waveform. The luminance is controlled by pulse width modulation to make the pulse width tw variable.

In principle, the current flowing through the LED is a direct current. It is possible to change the current value in accordance with the video signal Spx to adjust the luminance, but in this case, it is necessary to finely control the current value by the drive circuit. There is the problem that the circuit for this control ends up increasing the number of parts. It is easier to increase the resolution of the time than the resolution of the current value, so in general the pulse width modulation system such as shown by the current waveform of FIG. 2 is adopted.

Due to the nature of human senses, the luminance of light blinking in a manner staying lit for less than 1/60 of a second is perceived to have a constant luminance. Therefore, even an LED is driven by a current of the waveform shown in FIG. 2, if the period T of the current is shorter than the aforesaid time, the blinking light from the LED can be made to be perceived by people as light of a constant luminance. Further, generally, the magnitude of the luminance of an LED perceived by the human senses is proportional to the current flowing through the LED averaged over time. Therefore, the luminance changes in proportion with the duty of the pulse current.

The level of a video signal input to an LED display, however, is normalized in advance to match the luminance characteristics of a cathode ray tube (CRT). If such a video signal is input as it is to an LED, which has different luminance characteristics from a CRT pixel, the following problem arises.

FIG. 3 is a view of the relation of the luminances of an LED and CRT pixel with the level of an input signal.

In FIG. 3, the ordinate represents the luminance of an LED or CRT pixel by a relative value, while the abscissa represents the level of the signal input to an LED or a CRT pixel by a relative value. The curves indicated by A and B show the luminance characteristics of a CRT pixel and an LED, respectively.

Note that for the luminance characteristic A of a CRT pixel, the level of the signal is expressed by voltage, while for the luminance characteristic B of an LED, the level of the signal is expressed by the current flowing through the LED.

As shown in FIG. 3, the luminance of an LED has a linear relationship with the signal level, while the luminance of the CRT pixel has a nonlinear relationship with the signal level. In general, the luminance of a CRT pixel is proportional to the 2.2th power of the voltage level of the video signal. If a current proportional to a video signal normalized to match such a ce due to the above luminance characteristic of the video signal is input to the drive circuit 100 as the above video signal Spx. Specifically, for example, when driving an LED of a linear luminance characteristic by a video signal produced to match with CRT pixel emitting light of a luminance proportional to the 2.2th power of the signal level, a signal proportional to the 2.2th power of the video signal is generated to drive the LED.

In order to solve this problem, in an LED display of the related art, a signal corrected to eliminate the influence due to the above luminance characteristic of the video signal is input to the drive circuit 100 as the above video signal spx. Specifically, for example, when driving an LED of a linear luminance characteristic by a video signal produced to match with CRT pixel emitting light of a luminance proportional to the 2.2th power of the signal level, a signal proportional to the 2.2th power of the video signal is generated to drive the LED.

Summarizing the disadvantage to be solved by the invention, if the bit length of the original video signal is not sufficiently large, the binary data obtained by raising this digitalized image data to the 2.2th power is incapable of expressing fine changes of value in the region where the value of the original video signal is small. In other words, if the bit length of the digitalized video signal is small, the grey scale ends up rough in the low luminance region resulting in an unnatural picture. In order to avoid such a disadvantage, it is necessary to increase the bit length of the video signal. Specifically, in an LED display of the related art, it is necessary to generate a video signal of a length of 12 to 16 bits to reproduce a picture which had been expressed by a video signal of a length of 8 bits in the case of a CRT. If the bit length of the video signal is increased in this way, the bit length of the pulse width modulation circuits for driving the LEDs also has to be increased, so the overall circuit scale becomes larger and the cost and power consumption rise.

Further, the pulse-like waveform shown in FIG. 2 is generally generated by counting a clock signal serving as a time reference. Increasing the bit length of a video signal means increasing the number of times to count the clock signal by that extent, so when using a clock signal of the same frequency, the period T of pulse width modulation ends up longer. For example, when generating and modulating the pulse width of a 12-bit video signal, 4 bits larger than an 8-bit video signal, and comparing them with the same frequency of the clock signal, the period T of pulse width modulation becomes 16 times that of an 8-bit video signal. Since the period T of pulse width modulation is set using the characteristic of the human senses described above, if this period is too long, "flickering" where the blinking of the light will be perceived by the human eye will be caused and the picture will become hard to view. Furthermore, this flickering by nature is more noticeable to the human eye in an LED display compared with a CRT, so the period T of pulse width modulation has to be several times higher than that of the usual refresh rate, for example, for example 1/50 of a second.

To increase the bit length of a video signal and shorten the period T of pulse width modulation, it is enough to increase the frequency of the clock signal used in the pulse width modulation circuit, but this has the disadvantage of increasing the power consumption of the circuit. Further, as it is difficult to further increase the current frequency of 10 to 20 MHZ 10 or more fold, there is a limit to increasing the frequency of the clock signal.

SUMMARY OF THE INVENTION

An object of the present invention is to provide a modulation circuit outputting a pulse signal having a pulse length modulated in accordance with the value of the input data which is capable of setting the relationship between the input data and the pulse length to match with a predetermined characteristic without increasing the bit length of the input data or applying processing such as correction of the input data and an image display provided with such a modulation circuit.

To attain the above object, according to a first aspect of the present invention, there is provided a modulation circuit for outputting a pulse signal modulated in accordance with the value of input data by a predetermined period, comprising a clock generation circuit for generating and outputting a first clock pulse changing in frequency by the predetermined period; a clock counting circuit for receiving the first clock pulse, counting the first clock pulse from a predetermined initial value in an initial stage of the predetermined period, and outputting a clock count; and a pulse signal output circuit for comparing magnitudes of the clock count and the value of the input data and inverting a level of the pulse signal in the vicinity of a time when the magnitudes of the clock count and the value of the input data invert.

According to the modulation circuit of the present invention, the first clock pulse generated in the clock generation circuit is made variable in frequency in the predetermined period. The first clock pulse is counted from a predetermined initial value in the initial stage of the predetermined period in the clock counting circuit, and the count result is output as the clock count. The magnitudes of the clock count and the input data are compared in the pulse signal output circuit, and the pulse signal output by the pulse signal output circuit is inverted in level in the vicinity of the time when the magnitudes of the clock count and the value of the input data invert.

Preferably, the clock pulse generation circuit includes a frequency division setting circuit for outputting a frequency division setting changing in value by the predetermined period and a prescaler for receiving a second clock pulse and the frequency division setting, dividing the second clock pulse by a frequency division number in accordance with the frequency division setting, and outputting the first clock pulse.

According to the modulation circuit of the present invention having the above configuration, a frequency division setting changing in value by the predetermined period is generated and output at the frequency division setting circuit. The second clock pulse is divided by a frequency division number in accordance with the frequency division setting in the prescaler, and the divided signal is output as the first clock pulse. Accordingly, the period of the first clock pulse is changed by the predetermined period in accordance with the value of the frequency division setting.

Preferably, the clock pulse generation circuit includes a frequency division setting circuit for outputting a frequency division setting changing in value by the predetermined period; a prescaler for receiving the first clock pulse and the frequency division setting, dividing the first clock pulse by a frequency division number in accordance with the frequency division setting, and outputting a feedback signal; a phase comparison circuit for detecting a phase difference between a second clock pulse and the feedback signal and outputting a phase difference signal in accordance with the related phase difference; and an oscillation circuit for outputting the first clock pulse having a period in accordance with a level of the phase difference signal.

According to the modulation circuit of the present invention having the above configuration, the phase difference between the second clock pulse and the feedback signal is detected at the phase comparison circuit and a phase difference signal of a level in accordance with the related phase difference is generated and output. Then, this phase difference signal is input to the oscillation circuit, and the first clock pulse having a period in accordance with the level of the phase difference signal is generated and output at the oscillation circuit. Further, the first clock pulse is input to the prescaler, divided, and input as the period signal to the phase comparison circuit. The frequency division number of the prescaler is made variable by the frequency division setting generated by the frequency division setting circuit. The frequency division setting is generated as a signal changing by the predetermined period by the frequency division setting circuit. Accordingly, the period of the first clock pulse is made variable by the predetermined period in accordance with the value of the frequency division setting.

Preferably, the clock pulse generation circuit includes a frequency division circuit for dividing the first clock pulse by a predetermined frequency division number and outputting a frequency divided signal; a phase comparison circuit for detecting the phase difference between pulse period signal having the predetermined period and the frequency divided signal, and outputting a phase difference signal of a level in accordance with the phase difference; a variable clock period circuit for outputting a variable clock period signal varying in level by the predetermined period; and an oscillation circuit for outputting the first clock pulse having a period in accordance with the sum of levels of the variable clock period signal and the phase difference signal.

According to the modulation circuit of the present invention having the above configuration, in the frequency division circuit, the first clock pulse is divided by the predetermined frequency division number and a divided signal is output. The phase difference between the divided signal and a pulse period signal having the predetermined period is detected at the phase comparison circuit, and a phase difference signal of a level in accordance with the related phase difference is generated and output. On the other hand, the variable clock period signal varying in level by the predetermined period is generated in the variable clock period circuit. The clock period signal and the phase difference signal are input to the oscillation circuit. In the oscillation circuit, the first clock pulse having a period in accordance with the sum of levels of the clock period signal and the phase difference signal is generated and output. Accordingly, the period of the first clock pulse is changed by the predetermined period in accordance with the level of the clock period signal.

According to a second aspect of the present invention, there is provided a modulation circuit for outputting a pulse signal modulated in accordance with a value of input data by a predetermined period comprising a clock generation circuit for generating and outputting a first clock pulse having a frequency in accordance with the value of the input data; a clock counting circuit for receiving the first clock pulse, counting the first clock pulse from a predetermined initial value in an initial stage of the predetermined period, and outputting a clock count; and a pulse signal output circuit for comparing magnitudes of the clock count and the value of the input data and inverting a level of the pulse signal in the vicinity of a time when the magnitudes of the clock count and the value of the input data invert.

According to the modulation circuit of the present invention having the above configuration, the first clock pulse generated in the clock generation circuit is set in accordance with the value of the input data. The first clock pulse is counted from a predetermined initial value in the initial stage of the predetermined period in the clock counting circuit, and the count result is output as the clock count. The magnitudes of the clock count and the input data are compared in the pulse signal output circuit, and the pulse signal output by the pulse signal output circuit is inverted in level in the vicinity of the time when the magnitudes of the clock count and the value of the input data invert.

According to a third aspect of the present invention, there is provided an image display having a light emission element receiving a pulse signal modulated in accordance with a value of input data and emitting light with a luminance in accordance with the level of the pulse signal comprising a clock generation circuit for generating and outputting a first clock pulse changing in frequency by a predetermined period; a clock counting circuit for receiving the first clock pulse, counting the first clock pulse from a predetermined initial value in an initial stage of the predetermined period, and outputting a clock count; and a pulse signal output circuit for comparing magnitudes of the clock count and the value of the input data and inverting a level of the pulse signal in the vicinity of a time when the magnitudes of the clock count and the value of the input data invert.

According to the image display of the present invention having the above configuration, the first clock pulse generated in the clock generation circuit is changed in frequency by a predetermined period. The first clock pulse is counted from a predetermined initial value in the initial stage of the predetermined period in the clock counting circuit, and the count result is output as the clock count. The magnitudes of the clock count and the input data are compared in the pulse signal output circuit, and the pulse signal output by the pulse signal output circuit is inverted in level in the vicinity of the time when the magnitudes of the clock count and the value of the input data invert. The light emission element receiving the pulse signal emits light with a luminance in accordance with the level of the pulse signal.

Preferably, the clock pulse generation circuit includes a frequency division setting circuit for outputting a frequency division setting changing in value by the predetermined period and a prescaler for receiving a second clock pulse and the frequency division setting, dividing the second clock pulse by a frequency division number in accordance with the frequency division setting, and outputting the first clock pulse.

According to the image display of the present invention having the above configuration, a frequency division setting changing in value by a predetermined period is generated and output at the frequency division setting circuit. The second clock pulse is divided by a frequency division number in accordance with the frequency division setting in the prescaler, and the divided signal is output as the first clock pulse. Accordingly, the period of the first clock pulse is changed in accordance with the value of the frequency division setting by the predetermined period.

Preferably, the clock pulse generation circuit includes a frequency division setting circuit outputting the frequency division setting having the value varying by the predetermined period, a prescaler receiving the first clock pulse and the frequency division setting and outputting a feedback signal obtained by dividing the frequency of the first clock pulse by the frequency division number in accordance with the frequency division setting, a phase comparison circuit detecting a phase difference between a second clock pulse and the feedback signal and outputting a phase difference signal of a level in accordance with the related phase difference, and an oscillation circuit outputting the first clock pulses having the period in accordance with the level of the phase difference signal.

According to the image display of the present invention having the above configuration, the phase difference between the second clock pulse and the feedback signal is detected at the phase comparison circuit, and a phase difference signal of a level in accordance with the phase difference is generated and output. Then, the phase difference signal is input to the oscillation circuit, and a first clock pulse having a period in accordance with the level of the phase difference signal is generated and output in the oscillation circuit. Further, the first clock pulse is input to the prescaler and divided and input as the period signal to the phase comparison circuit. The frequency division number of the prescaler is changed by the frequency division setting generated by the frequency division setting circuit. The frequency division setting is generated by the frequency division setting circuit as a signal changing by a predetermined period. Accordingly, the period of the first clock pulse is made variable in accordance with the value of the frequency division setting by the predetermined period.

Preferably, the clock pulse generation circuit includes a frequency division circuit for dividing the first clock pulse by the predetermined frequency division number and outputting a frequency divided signal and a phase comparison circuit for detecting a phase difference between a pulse period signal having the predetermined period and the frequency divided signal and outputting a phase difference signal of a level in accordance with the related phase difference and the oscillation circuit outputs the first clock pulse having a period in accordance with a sum of levels of the variable clock period signal and the phase difference signal.

According to the image display of the present invention having the above configuration, the first clock pulse is divided by a predetermined frequency division number and the divided signal is generated and output at the frequency division circuit. The phase difference between the divided signal and a pulse period signal having the predetermined period is detected at the phase comparison circuit, and a phase difference signal of a level in accordance with the phase difference is generated and output. On the other hand, a variable clock period signal changing in level by the predetermined period is generated in the variable clock period circuit, and the clock period signal and the phase difference signal are input to the oscillation circuit. In the oscillation circuit, a first clock pulse having a period in accordance with the sum of levels of the clock period signal and the phase difference signal is generated and output. Accordingly, the period of the first clock pulse is made variable in accordance with the level of the clock period signal by the predetermined period.

According to a fourth aspect of the present invention, there is provided an image display having a light emission element receiving a pulse signal modulated in accordance with a value of input data and emitting light with a luminance in accordance with the level of the pulse signal; a clock generation circuit for generating and outputting a first clock pulse having a frequency in accordance with the value of the input data; a clock counting circuit for receiving the first clock pulse, counting the first clock pulse from a predetermined initial value in an initial stage of the predetermined period, and outputting a clock count; and a pulse signal output circuit for comparing magnitudes of the clock count and the value of the input data and inverting a level of the pulse signal in the vicinity of a time when the magnitudes of the clock count and the value of the input data invert.

According to the image display of the present invention having the above configuration, the first clock pulse generated in the clock generation circuit is set in accordance with the value of the input data. The first clock pulse is counted from the predetermined initial value in the initial stage of the predetermined period in the clock counting circuit, and the related count result is output as the clock count. The magnitudes of the clock count and the value of the input data are compared at the pulse signal output circuit, and the level of the output signal of the pulse signal output by the pulse signal output circuit is inverted in the vicinity of the time when the magnitudes of the clock count and the value of the input data invert. The light emission element receiving the pulse signal input thereto emits light with luminance in accordance with the level of the pulse signal.

BRIEF DESCRIPTION OF THE DRAWINGS

These and other objects and features of the present invention will be more apparent from the following description given with reference to the accompanying drawings, wherein.

DESCRIPTION OF THE PREFERRED EMBODIMENTS

Below, an explanation will be given of embodiments of a modulation circuit and an image display of the present invention by taking as an example a case where the present invention is applied to an LED display.

Figure 4:
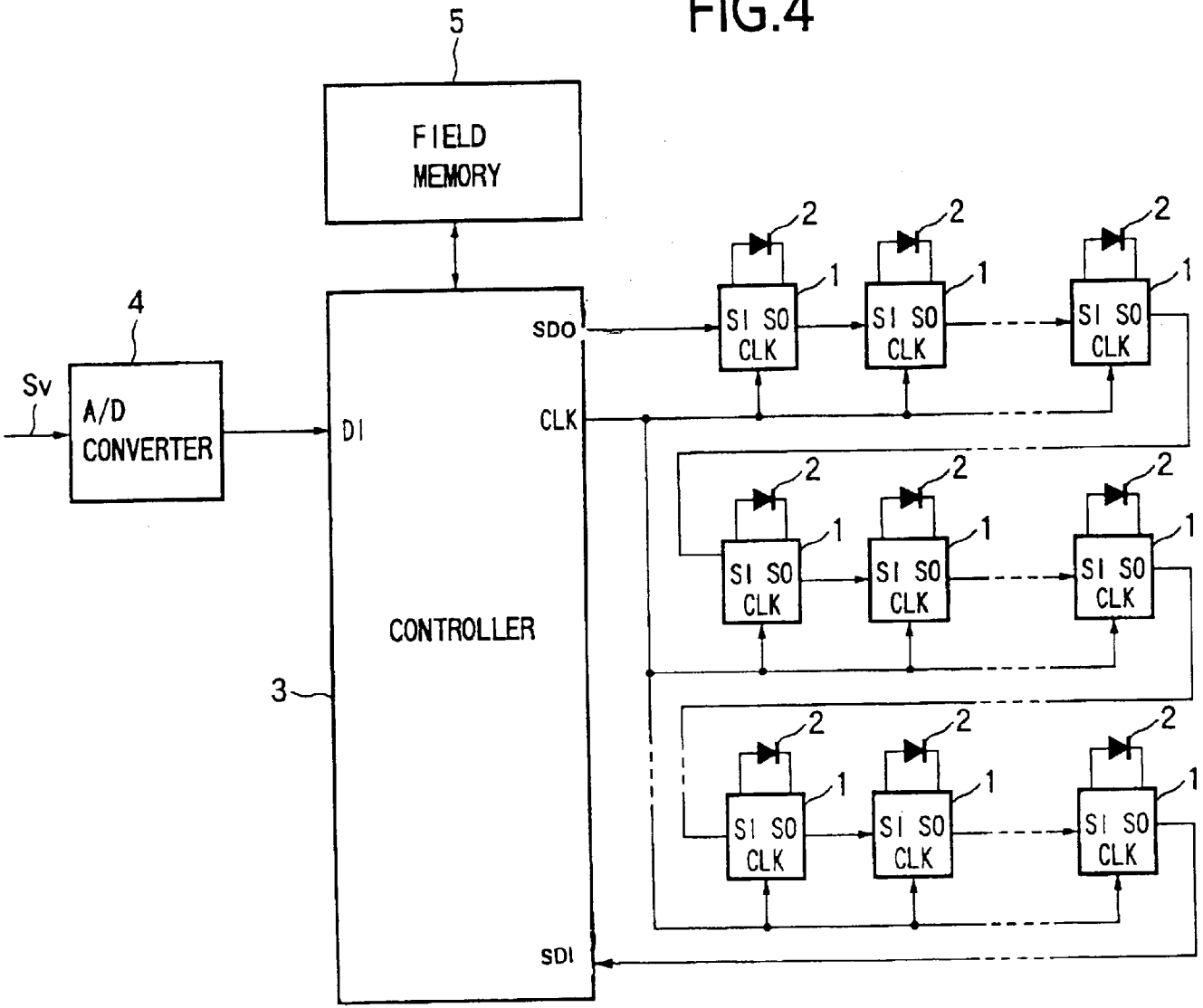
FIG. 4 is a block diagram of an LED display according to the present invention.

FIG. 4 is a block diagram of an LED display according to the present invention.

In FIG. 4, reference numeral 1 denotes a pulse width modulation circuit, 2 an LED, 3 a controller, 4 an A/D converter, and 5 a field memory.

The pulse width modulation circuit 1 supplies a pulse current to an LED 2 on the basis of data of a pulse width and a current transmitted from an output terminal SDO of the controller 3. There is one pulse width modulation circuit for the LED of each pixel, and the number of the pulse width modulation circuits is the same as that of the LEDs forming one screen.

The data of a pulse width received by the pulse width modulation circuit 1 from the controller 3 is serial data and is received at a serial data input terminal SI. In addition, the pulse width modulation circuit 1 is provided with a serial data output terminal SO for outputting the data received from the input terminal SI given a certain delay. The output terminal SO is connected in cascade with the input SI of other pulse width modulation circuits 1. In this way, the serial data input terminal SI and output terminal SO of the pulse width modulation circuit 1 are connected in cascade. By successively transmitting serial data from the input SI to the output terminal SO, data of the pulse width is transferred from the controller 3 to the pulse width modulation circuit 1. In FIG. 4, the last output terminal SO of the cascade connected pulse width modulation circuits 1 is connected to the controller 3. The controller 3 uses this returned signal to check the operational state of each pulse width modulation circuit 1.

Note that each pulse width modulation circuit 1 is provided with a clock input terminal CLK. The controller 3 supplies a common clock signal to each pulse width modulation circuit 1.

The controller 3 receives data of a digitalized video signal at the terminal D1 from the A/D converter 4. From this data, the controller 3 extracts data of luminance of each LED pixel and stores it in the field memory 5. The controller 3 further reads out data of each LED pixel from the field memory 5, converts it to serial data, and outputs it to pulse width modulation circuits 1 via the output terminal SDO. The serial data output from the output terminal SDO is synchronized with the clock signal generated by the controller 3. This clock signal is output to all pulse width modulation circuits 1 through the clock output terminal CLK.

The input terminal SDI of the controller 3 receives serial data fed back from the pulse width modulation circuits 1. This serial data contains information on the operational states of the pulse width modulation circuits 1 (breakdowns of LEDs, overheating of ICs, etc.) According to this information, the controller 3 notifies the breakdown on a not illustrated display.

The A/D converter 4 converts the analog video signal Sv into binary codes of a preset bit length and outputs the data to the controller 3.

The field memory 5 temporarily stores the luminance data of each LED pixel extracted from the controller 3. The luminance data of each LED pixel is managed and stored one field by one (or one frame). The controller 3 reads out the luminance data one field by one and outputs it to the pulse width modulation circuits 1.

The analog video signal Sv is converted into binary codes of a preset bit length by the A/D converter 4 and is output to the controller 3. The controller 3 extracts the luminance data of each pixel and outputs it to the field memory 5. The field memory 5 temporarily stores the luminance data of each LED pixel one field by one. The controller 3 reads out the stored luminance data of pixels for forming one field at a specified time and places it in a specified location of the controller 3. By specified processing described in detail later, the data is converted into serial data and output to the pulse width modulation circuits 1. According to the input luminance data of each pixel, the pulse width modulation circuits 1 supply pulse currents of a certain width and a certain peak value to the LEDs of pixels to light the LEDs and display a picture. A moving picture is displayed by repeating the operation of outputting luminance data of each field to the pulse width modulation circuits 1 and lighting the LEDs in the above way.

Note that the luminance data of the pixels was output to the pulse width modulation circuits 1 as serial data, but it may also be output as parallel data. In this case, there is the problem that the number of wires increases with the bit length of the data, but there is also an advantage that the luminance data can be set into the pulse width modulation circuits 1 faster than serial data.

In addition, it is not necessary to store all of the data that forms one field in the field memory 5. For example, a horizontal period of data may be first stored in the memory as a buffer and then output. In addition, if the conversion time of the A/D converter 4 and the processing time of the controller 3 are sufficiently short, it is possible to convert data to serial data directly for output without using a buffer.

Below, the operation of a pulse width modulation circuit 1 will be described.

Figure 5:
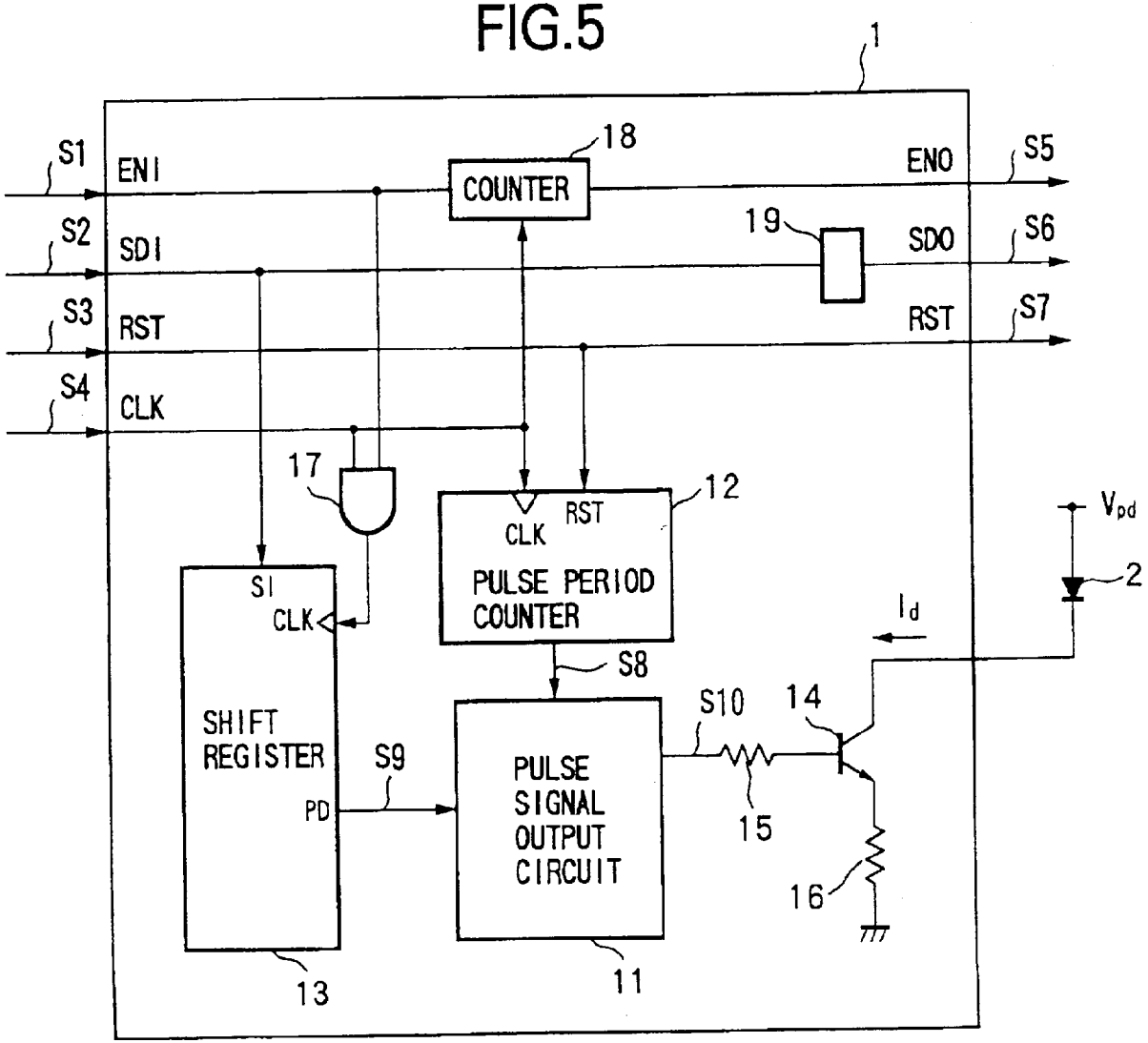
FIG. 5 is a block diagram of a pulse width modulation circuit.

FIG. 5 is a block diagram for explaining the operation of a pulse width modulation circuit 1.

In FIG. 5, a pulse signal output circuit is represented by 11, a pulse period counter by 12, a shift register by 13, an npn transistor by 14, resistors by 15 and 16, a counter by 18, and a delay circuit by 19.

The pulse signal output circuit 11 compares the magnitudes of a count S8 of a clock signal S4 output by the pulse period counter 12 and luminance data S9 output by the shift register, gives a signal S10 in accordance with the result of the comparison via the resistor 15 to a base of the npn transistor 14, and controls the ON or OFF state of the npn transistor 14. The pulse length of the pulse current flowing through the LED 2 is controlled by the signal S10 output by the pulse signal output circuit 11. When the output signal S10 of the pulse signal output circuit 11 is at a high level, the npn transistor 14 becomes ON, and the LED 2 emits light. When the output signal S10 is at a low level, the npn transistor 14 becomes OFF, and the LED 2 stops the light emission.

The pulse period counter 12 counts the clock of the clock signal S4 from the predetermined initial value and outputs the count S8 to the pulse signal output circuit 11. The count S8 of the pulse period counter 12 is reset in a period where a pulse period signal S3 is at a high level. The count is started again from the predetermined initial value after the pulse period signal S3 changes from the high level to low level.

The pulse period signal S3 is a signal for resetting the count S8 of the pulse period circuit 12 to the predetermined initial value and output from the controller 3 by a predetermined period. Accordingly, the pulse period counters 12 of the cascade connected pulse width modulation circuits 1 start the count all together from the predetermined initial value by the predetermined period.

The shift register 13 transfers serial data S2 sent from the controller 3 to the register of an internal portion in synchronization with the clock signal input from the AND circuit 17 for a period where an enable signal S1 is at a high level, and holds the data. The data held in the internal register is output as the luminance data S9 to the pulse signal output circuit 11.

The npn transistor 14 sends the pulse current through the LED 2 in accordance with the signal S10 of the pulse signal output circuit 11 received at the base via the resistor 15. Vpd indicates the voltage supplied to an anode of the LED 2. A common voltage Vpd is supplied to the anode of each LED 2. When the signal S10 is at a high level, the current flows through the base via the resistor 15, and the npn transistor 14 becomes ON. When the npn transistor 14 becomes ON, the current flows in the LED 2 from a power supply voltage Vpd through a collector and an emitter of the npn transistor 14 and the resistor 16 to a ground potential, and the LED 2 emits the light with a luminance in accordance with the current value. The npn transistor 14 becomes OFF when the signal S10 is at a low level, therefore the current does not flow through the LED 2 and it does not emit light.

The AND circuit 17 receives the enable signal S1 and the clock signal S4 and outputs the clock signal S4 to the shift register 13 in the period where the enable signal S1 is at a high level.

The counter 18 is a circuit for generating the enable signal to be supplied to the cascade connected pulse width modulation circuits 1. After detecting the change of the enable signal S1 from a high level to low level, an enable signal S5 having a predetermined clock length is output.

The delay circuit 19 outputs a serial data signal S6 obtained by giving a delay of a predetermined number of clocks to the input serial data signal S2. This delay is the delay for synchronizing the enable signal S5 output by the counter 18 and the serial data signal S6.

Figure 6:
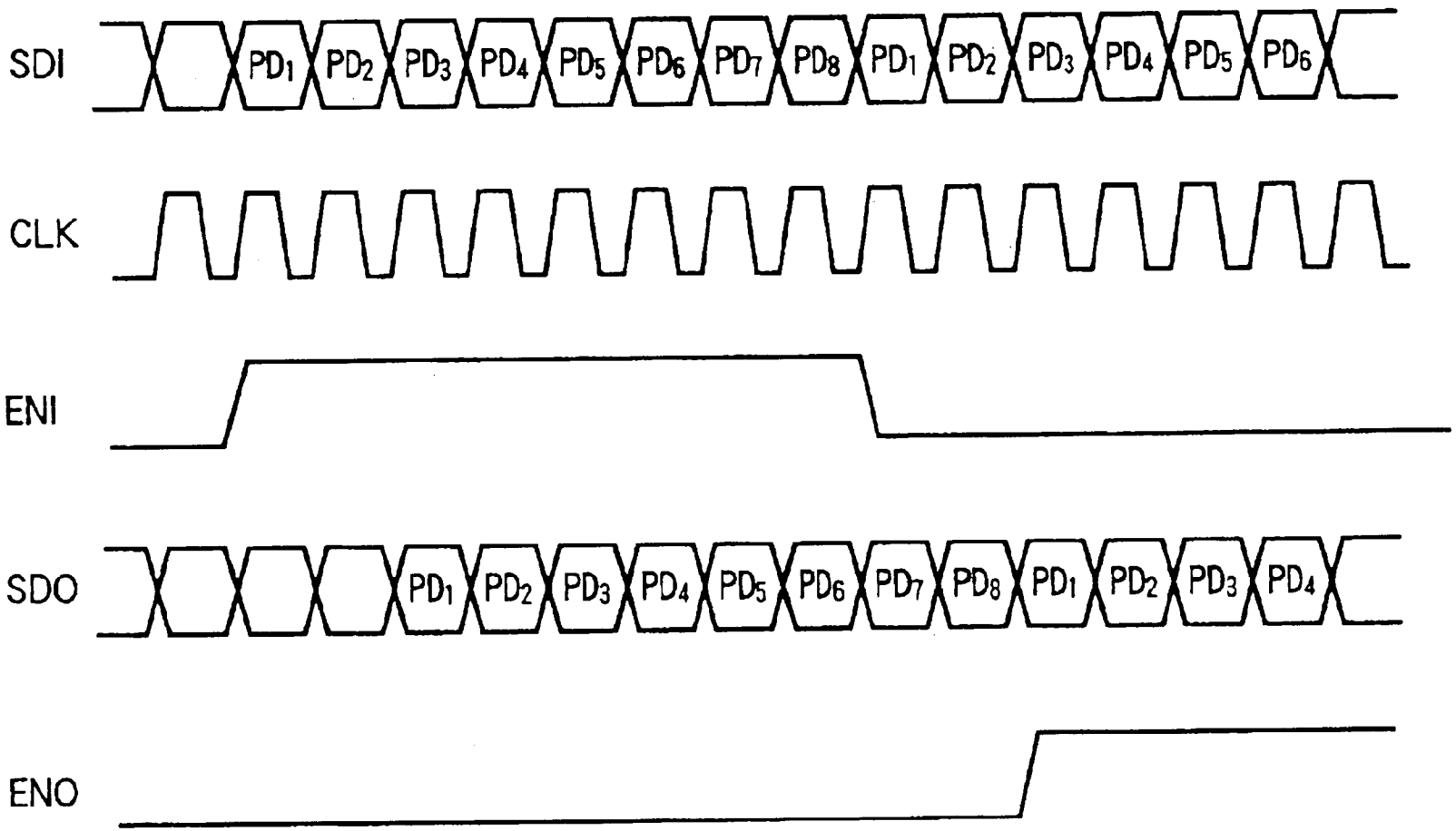
FIG. 6 is a timing chart for explaining an operation of a pulse width modulation circuit.

FIG. 6 is a timing chart for explaining the operation of a pulse width modulation circuit 1.

In FIG. 6, SDI indicates the serial data signal S2 input to a pulse width modulation circuit 1, CLK indicates the clock signal S4, ENI indicates the enable signal S1 input to the pulse width modulation circuit 1, SDO indicates the serial data signal S6 output from the pulse width modulation circuit 1, and ENO indicates the enable signal S5 output from the pulse width modulation circuit 1.

The signal output from the terminal SDO of the controller 3 to each pulse width modulation circuit 1 in FIG. 4 corresponds to the enable signal S1, serial data signal S2, and the pulse period signal S3 in FIG. 5. Among them, the serial data signal S2 is comprised of the data setting the pulse length. In FIG. 6, the data setting the pulse length is comprised of 8 bits, and the bits are indicated as PD1 to PD8. Accordingly, the length of one word of the serial data output from the controller 3 to the pulse width modulation circuit 1 becomes 8 bits in FIG. 6.

Note that the bit length of the data setting the pulse length of the pulse current and the length of one word of the serial data are not limited to the example of FIG. 6 and can be freely set in accordance with the length of the data which can be set in the shift register 13.

When the enable signal SI changes from a low level to high level in synchronization with the clock signal S1, the data of the serial data signal S2 is input to the internal register of the shift register 13 in synchronization with the clock output by the AND circuit 17. After the input of the data to the internal register is completed, the luminance data S9 is updated to the data input to the internal register.

The enable output signal S5 changes from a low level to high level in synchronization with the change of the enable input signal S1 from a high level to low level. The period for which the output signal S4 holds the enable signal of a high level is fixed to a predetermined number of clocks. In the example of FIG. 6, an 8-clock high level signal is are generated and output by the counter 18.

The output signal S6 of the serial data is generated by delaying the input signal S2 of the serial data by exactly a predetermined number of clocks (2 clocks in the example of FIG. 6) in the delay circuit 19. The length of the delay is set so that the time when the enable output signal S5 changes to a high level and the time when a header data (PD1 in FIG. 6) of 8 bits of serial data appears at the terminal SDO coincide. By this, the serial data passing through the pulse width modulation circuit 1 with the terminal SDI and the terminal SDO cascade connected therein is sequentially set in the shift registers 13 of the pulse width modulation circuits 1 in the order of the cascade connection. Namely, the serial data output at first is set in the pulse width modulation circuit 1 connected to the terminal SDO of the controller 3, while the serial data output last is set in the pulse width modulation circuit 1 connected to the terminal SDI.

The pulse signal output circuit 11 compares the magnitudes of the count S8 of the clock signal S4 and the luminance data S9. When the luminance data S9 is larger than the count S8, the output signal S10 is set at a high level and current flows through the LED 2. Accordingly, when the luminance data S9 is larger than the initial value of the count S8, at the time of the start of counting of the pulse period counter 12, the current flows through the LED 2 and the LED 2 emits light.

The count S8 of the pulse period counter 12 increases along with the input of the clock. When it exceeds the value of the luminance data S9 (PD1 to PD8), the output signal S10 of the pulse signal output circuit 11 becomes a low level, the npn transistor 14 is set to OFF, current no longer flows through the LED 2, and the emission of light stops. Thereafter, after the clock signal S4 is counted in the pulse period counter 12 up to a value in accordance with the bit length of the counter, for example 255 as the maximum value of 8 bits, the count S8 is reset by the pulse period signal S8, and the count is started again from the predetermined initial value. When the pulse period counter 12 starts the count again, the output signal S10 of the pulse signal output circuit 11 becomes a high level and the npn transistor 14 is set to ON. When the count S8 exceeds the value of the luminance data S9, the output signal S10 becomes a low level and the npn transistor 14 is set to OFF again. By repeating this operation, a pulse current of a period in accordance with the bit length of the pulse period counter 12 flows through the LED 2 with the pulse length in accordance with the value of the luminance data S9 (PD1 to PD8).

The above explanation was given by taking as the example the case where the count S8 output by the pulse period counter 12 increases together with the count of the clock, but even in a case where the count S8 decreases together with the count of the clock, it is possible to send a current of the pulse length in accordance with the luminance data S9 (PD1 to PD8) through the LED 2.

In this case, the count is started in the pulse period counter 12 from the predetermined initial value, for example 255 as the maximum value of 8 bits, and the count S8 is decremented together with the input of the clock. Also, at the time when the count is started in the pulse period counter 12, the output signal S10 of the pulse signal output circuit 11 is set at a low level and the npn transistor 14 is set to OFF, while at the time when the luminance data S9 becomes larger than the count S8 of the pulse period counter 12, the output signal S10 of the pulse signal output circuit 11 is set at a high level and the npn transistor 14 is set to ON. Thereafter, the count S8 is reset after the count is carried out up to the predetermined minimum value, for example, zero in the pulse period counter 12, and the decrementation is started again from the predetermined initial value. When the decrementation is started again in the pulse period counter 12, the npn transistor 14 is set OFF by the pulse signal output circuit 11, and the npn transistor 14 is set ON again at the time when the luminance data S9 exceeds the value of the count S8. By repeating this operation, the pulse current of the period in accordance with the bit length of the pulse period counter 12 flows through the LED 2 with the pulse length in accordance with the value of the luminance data S9 (PD1 to PD8).

As explained above, the 8-bit serial data comprised of the luminance data PD1 to PD8 is output from the controller 3 to the pulse width modulation circuits 1 and held in the shift registers 13 of the pulse width modulation circuits 1. Then, a pulse current having a pulse length in accordance with the luminance data held in the shift register 13 of each pulse width modulation circuit 1 flows through each LED 2.

Note that the pulse width modulation circuit 1 shown in FIG. 5 is one for when the luminance data output from the controller 3 to the pulse width modulation circuits 1 is serial data, but as already mentioned, the data set in the pulse width modulation circuits 1 from the controller 3 in the present invention is not limited to serial data and may be for example parallel data too. In that case, for example a general transfer system of parallel data provided with an address bus and a data bus and setting the luminance data in the pulse width modulation circuit of a designated address can be used.

Next, an explanation will be given of the generation circuit of the clock signal S4.

Figure 7:
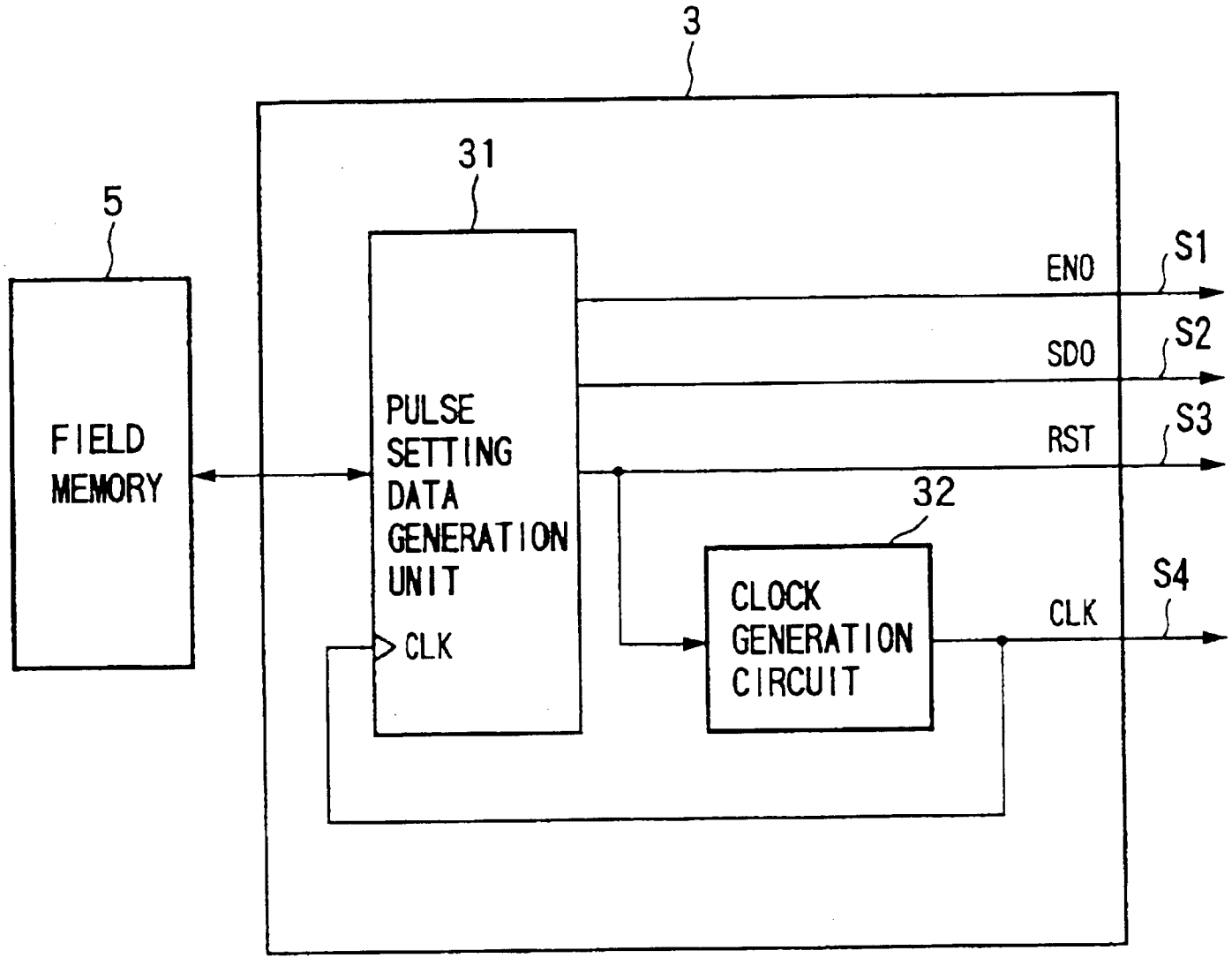
FIG. 7 is a block diagram for explaining operation of a controller.

FIG. 7 is a block diagram for explaining the operation of the controller 3.

In FIG. 7, 31 denotes a pulse setting data generation unit, while 32 denotes a clock generation circuit. Other than these, the same reference numerals as those of FIG. 7 indicate the same components.

The pulse setting data generation unit 31 reads out the luminance data of the pixels as the digital data from the field memory 5, converts the same to a serial data signal S2 synchronized with the clock signal S4 by the clock generation circuit 32, and outputs the same from the terminal SDO. Also, an enable signal S1 synchronized with this serial data signal S2 is generated and output from the terminal ENO. The enable signal S1 has a number of clocks equal to the number of clocks of one word of the serial data signal.

The pulse setting data generation unit 31 generates a high level pulse signal for resetting the count of the pulse period counter 12 by a predetermined period and outputs the same as the pulse period signal S3 from a terminal RST to the pulse width modulation circuits 1. This pulse period signal S3 is output to also the clock generation circuit 32.

The clock generation circuit 32 outputs a clock signal S4 with a period made variable in synchronization with the pulse period signal S3 to the pulse width modulation circuits 1. As mentioned above, the pulse period counter 12 is reset by the pulse period signal S3, therefore the period of the pulse current flowing through the LED 2 and the period of the variation of the period of the clock signal S4 coincide.

The luminance data of the pixels read out from the field memory 5 is converted to the serial data S2 at the pulse setting data generation unit 31, output to the pulse width modulation circuits 1 together with the enable signal S1, and set in the internal registers of the shift registers 13.

On the other hand, the clock signal 4 with the period made variable in synchronization with the pulse period signal S3 is output from the clock generation circuit 32 to the pulse width modulation circuits 1 and counted by the pulse period counters 12. Where the period of the counted clocks is constant, the number of counted clocks (count) and the time required for the count (count time) are proportional, but the clock signal 4 is made variable in the period in synchronization with the pulse period signal S3, therefore the count S8 by the pulse period counter 12 and the count time are not proportional in this case. Namely, the pulse lengths of the luminance data S9 and the current flowing through the LED 2 are not proportional, and also the luminance data S9 and the light emission luminance of the LED 2 are no longer proportional. In other words, the relationship between the luminance data set in the pulse width modulation circuit 1 and the light emission luminance of the LED 2 is controlled in accordance with the period of the clock signal 4 generated by the clock generation circuit 32.

Next, an explanation will be given of embodiments of the clock generation circuit 32.

Figure 8:
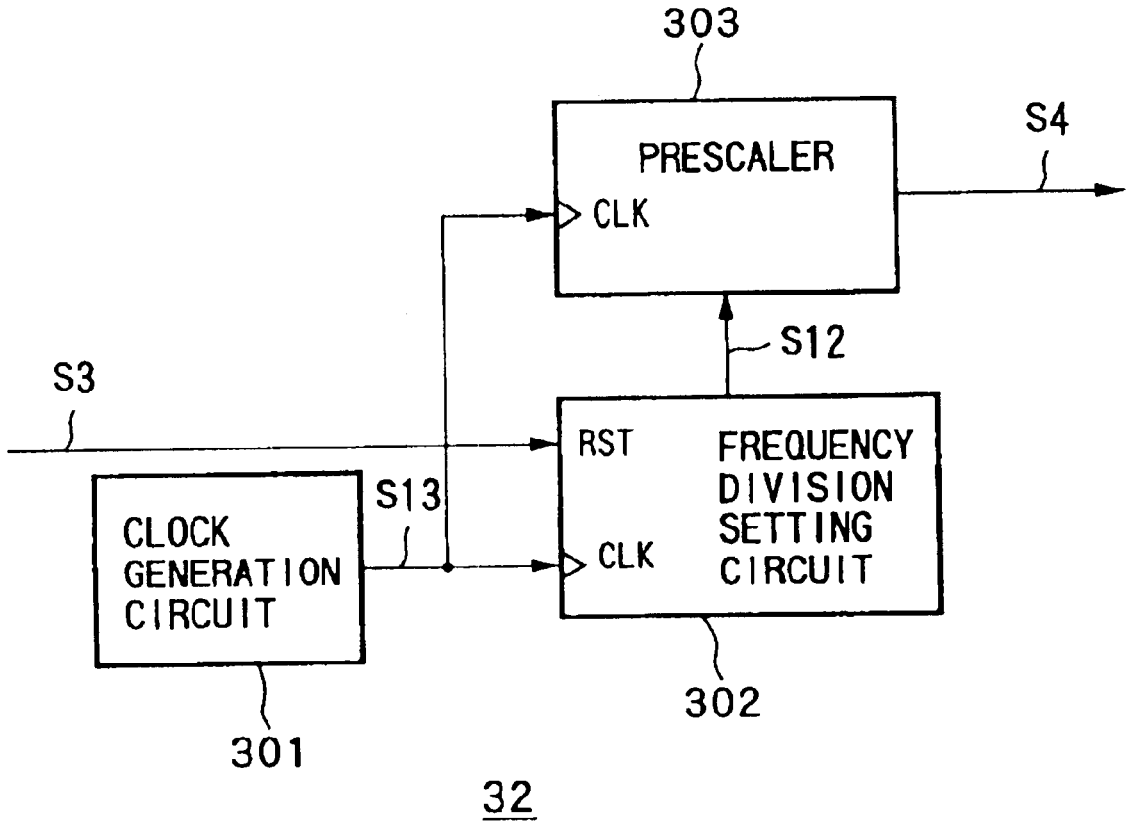
FIG. 8 is a block diagram of a first embodiment of a clock generation circuit.

FIG. 8 is a block diagram of a first embodiment of the clock generation circuit 32.

In FIG. 8, 301 denotes a clock generation circuit, 302 a frequency division setting circuit, and 303 a prescaler.

The clock generation circuit 301 generates a clock signal S13 of constant frequency and outputs the same to the frequency division setting circuit 302 and the prescaler 303.

The frequency division setting circuit 302 receives and counts the clock signal S13, generates a frequency division setting signal S12 of a value in accordance with the count, and outputs the same to the prescaler 303. Also, it receives the pulse period signal S3. When the pulse period signal S3 is at a high level, it resets the count of the clock signal S13 and the value of the frequency division setting signal S12 and starts the count of the clock signal S13 again from the time when the pulse period signal S3 changes from a high level to low level.

The prescaler 303 receives the clock signal S13, divides the clock signal S13 by a frequency division number in accordance with the value of the frequency division setting signal S12 to generate signals, and outputs the same as the clock signal S4.

The value of the frequency division setting signal S12 output by the frequency division setting circuit 302 is set in accordance with the count of the clock signal S13, so varies along with the elapse-of time. Also, the frequency division number of the prescaler 303 is controlled by the value of the frequency division setting signal S12. Accordingly, the period of the clock signal S4 obtained by dividing the frequency of the clock signal S13 of a constant frequency generated in the clock generation circuit 301 at the prescaler 303 varies along with the elapse of time in accordance with the frequency division setting signal S12.

Figure 9:
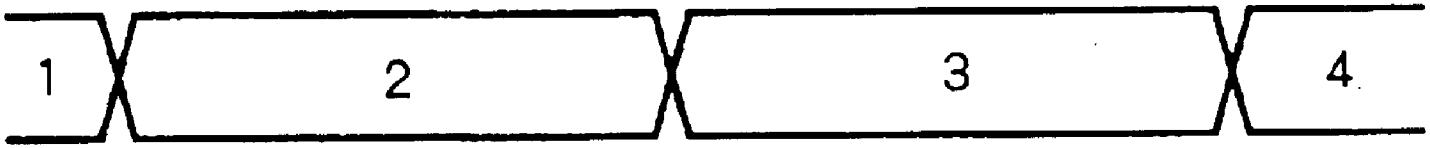
FIG. 9 is a timing chart of a relationship between a frequency division setting signal and a clock signal.
Figure 9:
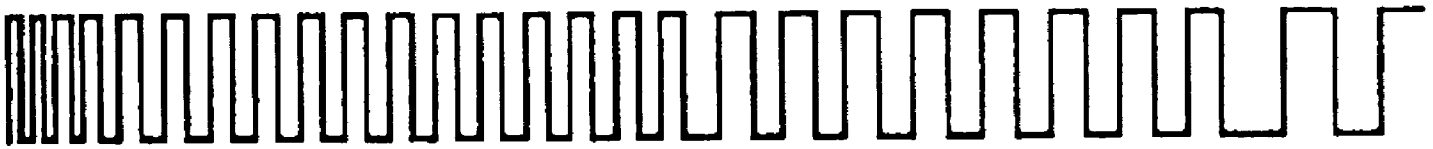

FIG. 9 is a timing chart of the relationship between the frequency division setting signal S12 and the clock signal S4.

In FIG. 9, S12 indicated the frequency division setting signal S12, and S4 indicates the clock signal S4. Also, numerals (1 to 4) in the frequency division setting signal S12 indicates the frequency division number.

As shown in FIG. 9, along with the change of the setting of the frequency division number of the frequency division setting signal S12 from 1 to 4, the period of the clock signal S4 becomes long along with the elapse of time.

Figure 10:
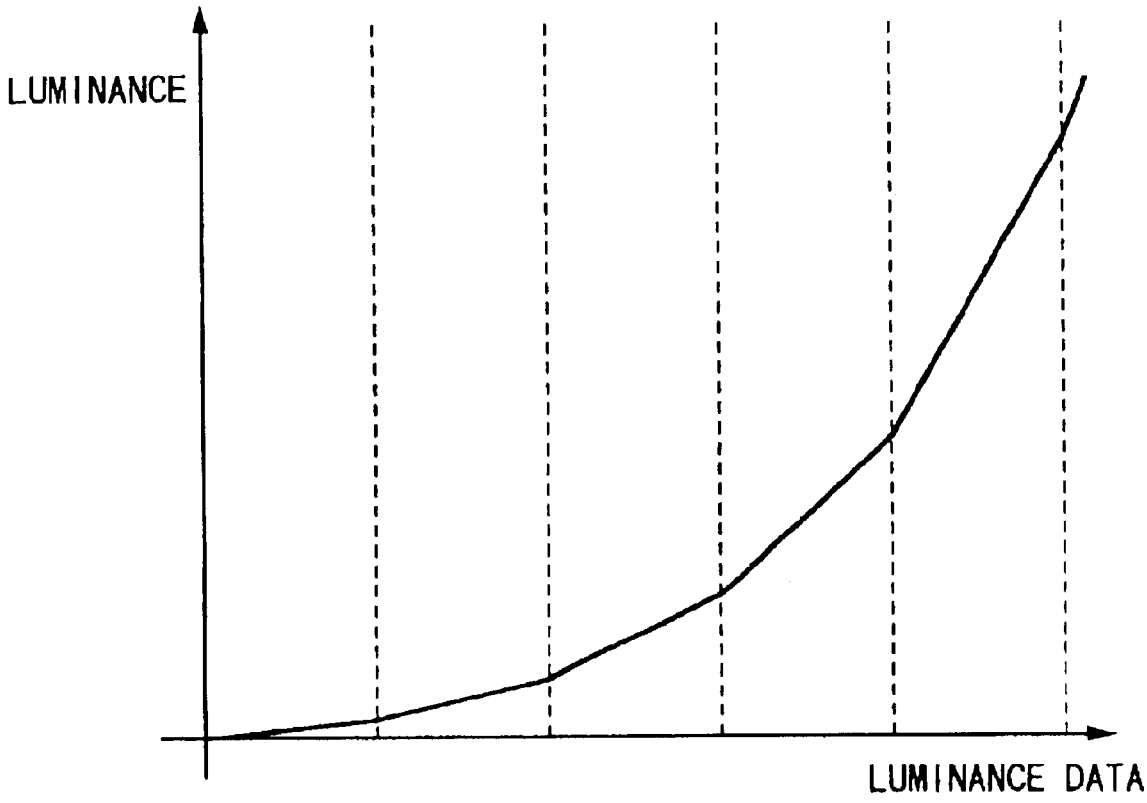
FIG. 10 is a graph of the relationship between luminance data corrected in its γ characteristic by the clock generation circuit and the luminance.

FIG. 10 is a graph of the relationship between luminance data having a γ characteristic corrected by the clock generation circuit 32 and the luminance data.

In FIG. 10, the ordinate indicates the relative value of the light emission luminance of the LED, and the abscissa indicates the luminance data setting in the pulse width modulation circuit 1. Also, the broken line of the Figure indicates the value of the luminance data with a changing frequency division setting signal S12.

Figure 1:
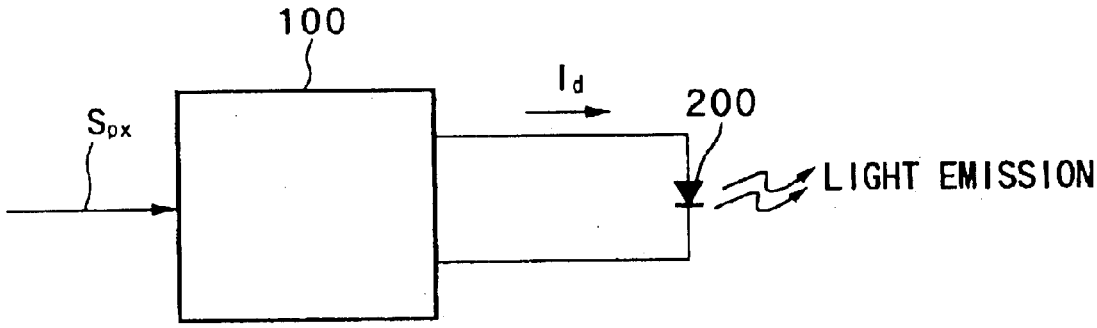
FIG. 1 is a view of a drive circuit of an LED comprising a pixel of an LED display.
Figure 2:
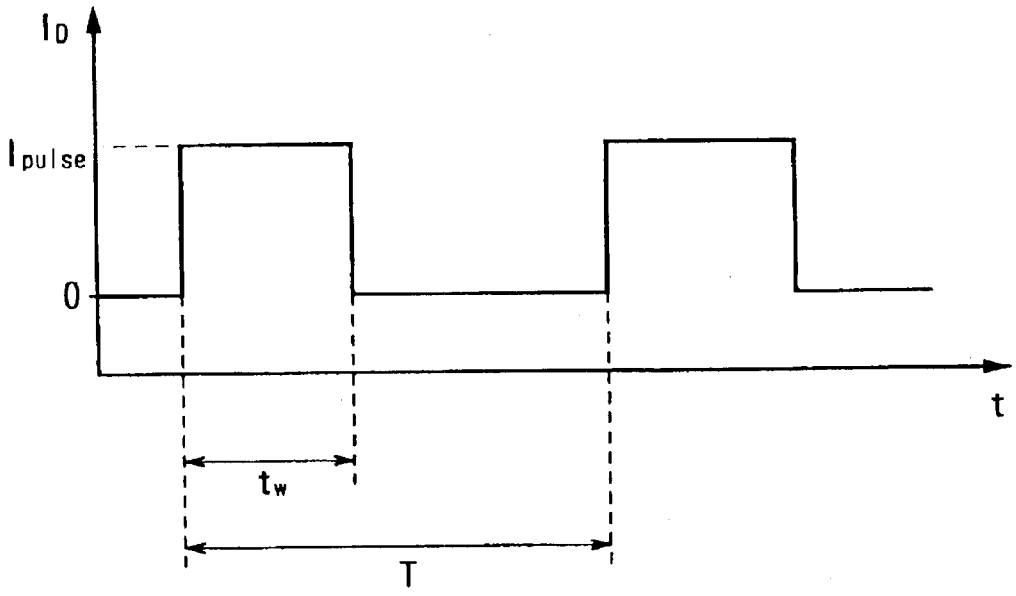
FIG. 2 is a view of a waveform of a current flowing through the LED of FIG. 1.
Figure 3:
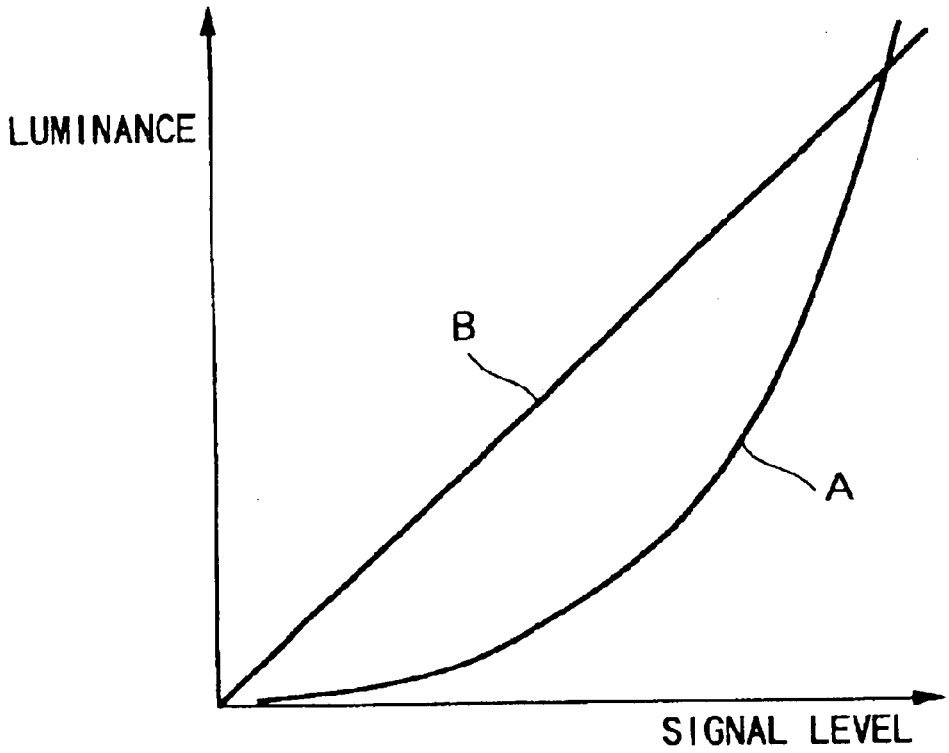
FIG. 3 is a view of the relationship of the luminances of an LED and CRT pixel with respect to the input signal level.

The luminance characteristic shown in FIG. 10 is obtained by generating the frequency division setting signal S12 so as to approach the γ characteristic of the graph A in FIG. 3. The graph of FIG. 10 becomes a graph of a bent line comprised of a plurality of straight lines having different inclinations. The inclination of each straight line corresponds to the period of the clock signal S4. When the period of the clock signal S4 is short, the inclination of the straight line becomes small, while when the period of the clock signal S4 is long, the inclination of the straight line becomes large. As mentioned above, in the γ characteristic of a CRT, generally the luminance is proportional to the 2.2 power of the luminance data. When regarding this as being about square, the inclination of a curve indicating the relationship between the luminance data and the luminance becomes large in proportion to the luminance data. Accordingly, when making the γ characteristic of the CRT approximate the graph of the bent line shown in FIG. 10, the inclination of each straight line may be set so as to become large in proportion to the luminance data. That is, if a frequency division setting signal S12 whereby the period of the clock signal S4 becomes large in proportion to the luminance data is generated in the pulse generation circuit 32, the γ characteristic of the CRT can be corrected.

Figure 11:
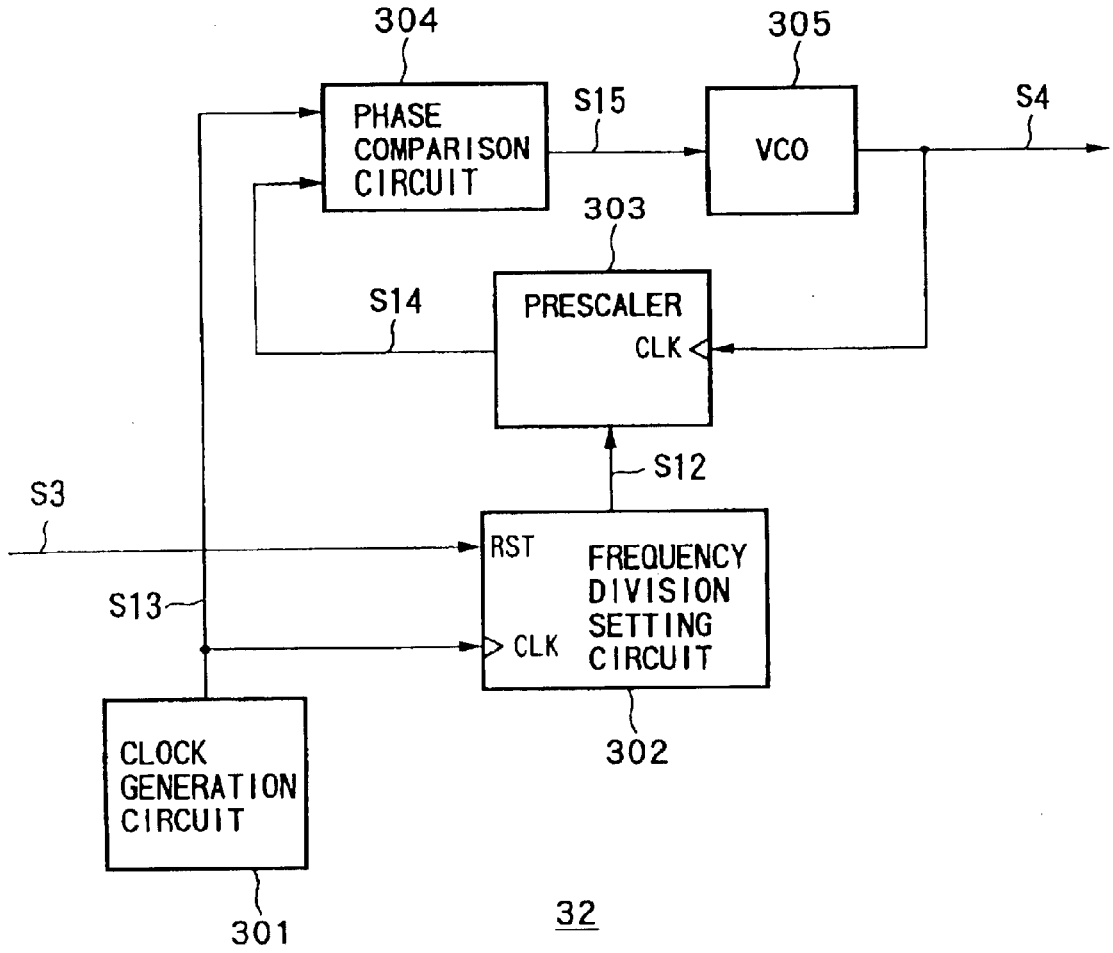
FIG. 11 is a block diagram of a second embodiment of the clock generation circuit.

Note that, in the pulse generation circuit 32 shown in FIG. 8, the period of the clock signal S4 was made variable by dividing the clock signal S13 generated by the clock generation circuit 301 at the prescaler 303, but conversely to this, it is also possible to make the period of the clock signal S4 variable by multiplying the clock signal S13 by the circuit as shown in FIG. 11.

FIG. 11 is a block diagram of a second embodiment of the clock generation circuit 32.

In FIG. 11, 304 denotes a phase comparison circuit, and 305 denotes a voltage controlled oscillator (VCO). Other than these, the same reference numerals as those of FIG. 8 and FIG. 11 indicate the same components.

The phase comparison circuit 304 detects the phase difference between the clock signal S13 output by the clock generation circuit 301 and a feedback signal S14 output by the prescaler 303 and outputs a phase difference signal S15 of the level in accordance with the phase difference.

The VCO 305 receives the phase difference signal S15 and outputs a clock signal S4 of a frequency in accordance with the level of the phase difference.

The prescaler 303 receives the clock signal S4, divides the clock signal S4 by a frequency division number in accordance with the value of a frequency division setting signal S12, and outputs the obtained signal as the feedback signal S14 to the phase comparison circuit 304.

The clock generation circuit 301 generates a clock signal S13 of a constant frequency and outputs the same to the frequency division setting circuit 302 and the phase comparison circuit 304.

The phase comparison circuit 304, VCO 305, and prescaler 303 have the configuration of a general PLL. When the PLL is locked, a clock signal S4 having a frequency where the phases of the clock signal S13 and the feedback signal S14 coincide is generated by the VCO 305. On the other hand, the feedback signal S14 is a signal generated by the division of the clock signal S4 by the prescaler 303, therefore the frequency of the clock signal S4 has a magnitude of the frequency division number times of the feedback signal S14. Since the phases of this feedback signal S14 and the clock signal S13 coincide, the frequency of the clock signal S4 will have a magnitude of the frequency division number times the clock signal S13. Accordingly, if the frequency division setting signal S12 is generated by the pulse generation circuit 32 so that the period of the clock signal S4 becomes large in proportion to the luminance data, the γ characteristic of the CRT can be corrected even by the pulse generation circuit 32 shown in FIG. 11.

Figure 12:
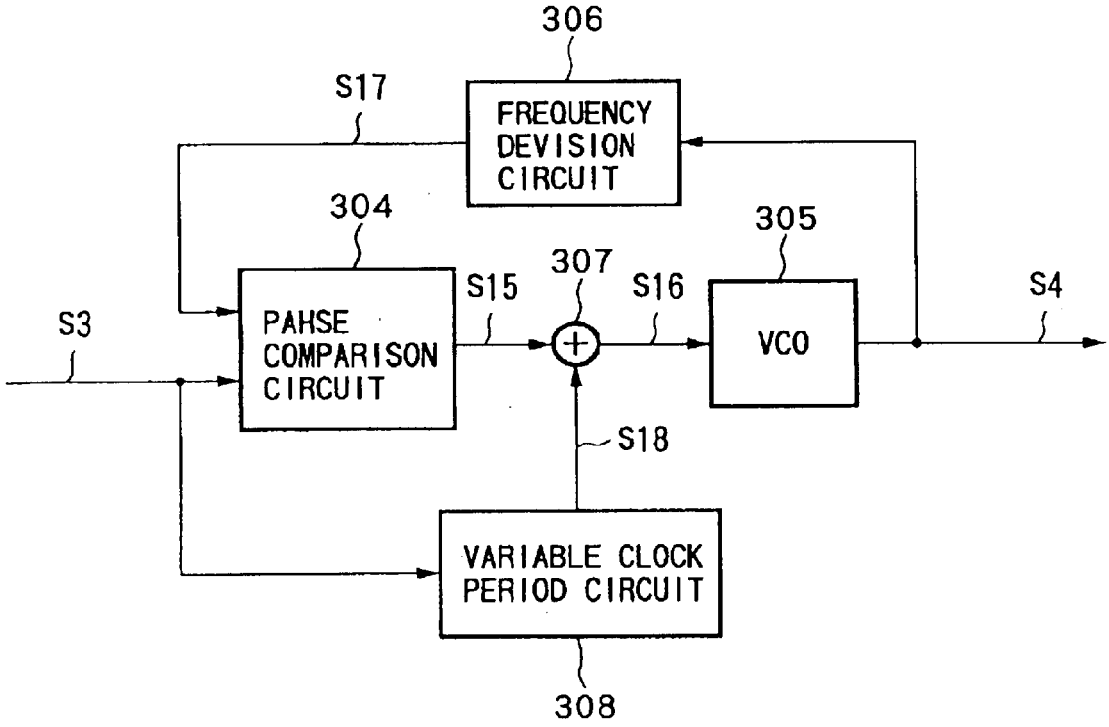
FIG. 12 is a block diagram of a third embodiment of the clock generation circuit.

In the pulse generation circuits of FIG. 8 and FIG. 11, the γ characteristic of the CRT is made to approximate the graph of the bent line as shown in the luminance characteristic of FIG. 10, but according to the pulse generation circuit shown in FIG. 12, it is also possible to obtain a luminance characteristic nearer the γ characteristic of the CRT by smoothly changing the frequency of the clock signal S4.

FIG. 12 is a block diagram of a third embodiment of the clock generation circuit 32.

In FIG. 12, 306 denotes a frequency division circuit, 307 an adder circuit, and 308 a variable clock period circuit. Other than these, the same reference numerals in FIG. 11 and FIG. 12 indicate the same components.

The phase comparison circuit 304 detects the phase difference between the pulse period signal S3 and a feedback signal 17 output by the frequency division circuit 306 and outputs a phase difference signal S15 of a level in accordance with the phase difference.

The adder circuit 307 receives the phase difference signal S15 of the phase comparison circuit 304 and a variable clock period signal S18 of the variable clock period circuit 308 and outputs an added signal S16 obtained by adding the levels of the phase difference signal S15 and the variable clock period signal S18 to the VCO 305.

The VCO 305 receives the added signal S16 of the adder circuit 307 and outputs the clock signal S4 of a period in proportion to the level of the added signal S16.

The frequency division circuit 306 receives the clock signal S4, divides the clock signal S4 by a predetermined frequency division number, and outputs a feedback signal S17 obtained to the phase comparison circuit 304.

The variable clock period circuit 308 receives the pulse period signal S3, generates a variable clock period signal S18 in synchronization with the pulse period signal S3, and outputs the same to the adder circuit 307. The variable clock period signal S18 is an analog signal changing in signal level in time with a period equal to the pulse period signal S3. The frequency of the clock signal S4 smoothly varies in accordance with the level of this variable clock period signal S18.

The phase comparison circuit 304, the VCO 305, and the frequency division circuit 306 comprise a PLL similar to the pulse generation circuit shown in FIG. 11. The difference of this from the PLL comprised in FIG. 11 resides in the point that the variable clock period signal S18 is added to the phase difference signal S15 output from the phase comparison circuit 304 to the VCO 305 by the adder circuit 307. When the PLL is locked, a clock signal S4 having a frequency whereby the phases of the pulse period signal S3 and the feedback signal S17 of the frequency division circuit 306 coincide is generated by the VCO 305. On the other hand, the feedback signal S17 is a signal generated by the division of the clock signal S4 by the frequency division circuit 306, therefore the clock signal S4 has the frequency division number of clocks in one period of the feedback signal S17. Further, the VCO 305 receives as input the signal S16 obtained by adding the variable clock period signal S18 varying in level in synchronization with the pulse period signal S3 and the phase difference signal S15 by the adder circuit 307, therefore the period of the clock signal S4 is made variable in accordance with the variation of the signal level of the variable clock period signal S18. Namely, the clock signal S4 has a number of clocks corresponding to the frequency division number of the frequency division circuit 306 in one period of the pulse period signal S3. The period of the clock varies in accordance with the level of the variable clock period signal S18.

Accordingly, if a variable clock period signal S18 having a suitable waveform is generated in the variable clock period circuit 308, the γ characteristic of the CRT can be corrected.

Figure 13:
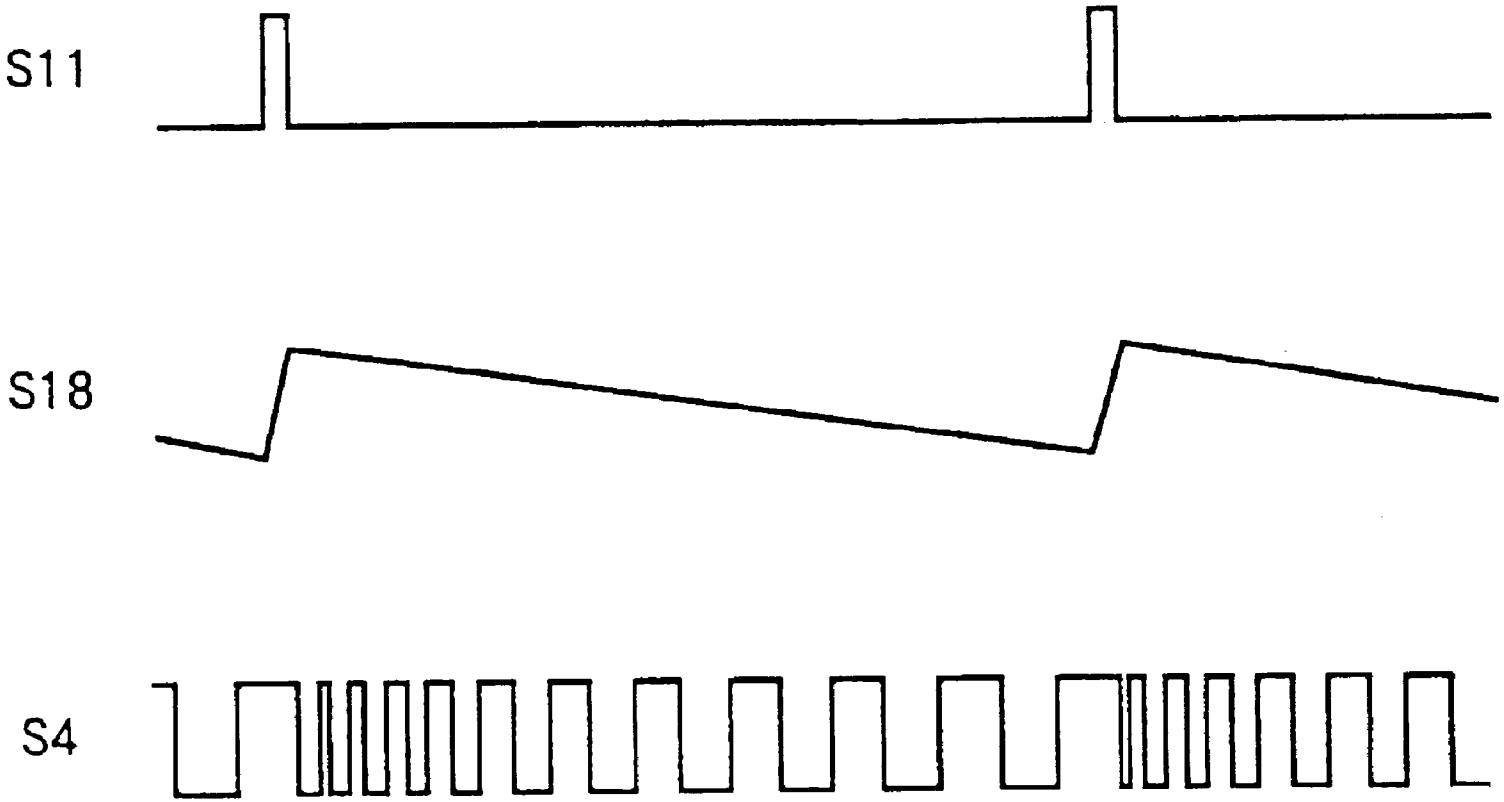
FIG. 13 is a timing chart for explaining the relationship of a variable clock period signal and clock signal with respect to a pulse period signal.

FIG. 13 is a timing chart for explaining the relationship of the variable clock period signal S18 and the clock signal S4 with respect to the pulse period signal S3.

In FIG. 13, S3 indicates the pulse period signal S3, S18 indicates the variable clock period signal S18, and 54 indicates the clock signal S4.

As shown in FIG. 13, the variable clock period signal S18 has a saw like waveform synchronized with the pulse period signal S3 and decreases in proportion to time. The period of the clock signal S14 smoothly becomes longer in proportion to time in accordance with this variable clock period signal S18. Namely, the period of the clock signal S14 becomes long in proportion to the number of the counted clock, so the period of the clock signal S14 becomes long in proportion to the luminance data. As already mentioned, the γ characteristic of the CRT can be corrected by making the period of the clock signal S4 variable in proportion to the luminance data, therefore the γ characteristic can also be corrected by the pulse generation circuit 32 shown in FIG. 12.

Note that, in both of FIG. 9 and FIG. 13, the period of the clock signal S4 is made to change so as to become longer in proportion to time, but conversely it is possible to correct the γ characteristic of the CRT by changing the period to become shorter along with the elapse of time. In this case, as already mentioned, at the time when the pulse period counter 12 starts the count, the npn transistor 14 may be set OFF and the count S8 of the pulse period counter 12 may be decremented together with the count of the clock signal S4, while when the luminance data S9 becomes larger than the count S8 of the pulse period counter 12, the npn transistor 14 may be set ON. If the pulse width modulation circuits 1 are operated in this way, the period of the clock signal S4 is made variable so that the period of the clock signal S4 becomes long when the value of the luminance data is large and the period of the clock signal S4 becomes short when the value of the luminance data is small, therefore the γ characteristic of the CRT can be corrected.

In the pulse generation circuits shown in FIG. 8, FIG. 11, and FIG. 12, the γ characteristic of the CRT is corrected by supplying the common clock signal S4 with the period made variable along with the elapse of time to all pulse width modulation circuits 1. If the period of the clock counted by the pulse period counter 12 can be individually set in the pulse width modulation circuit 1, the γ characteristic of the CRT can be corrected also by generating suitable luminance data and clock period data in the pulse setting data generation unit and setting this in each pulse width modulation circuit 1.

Figure 14:
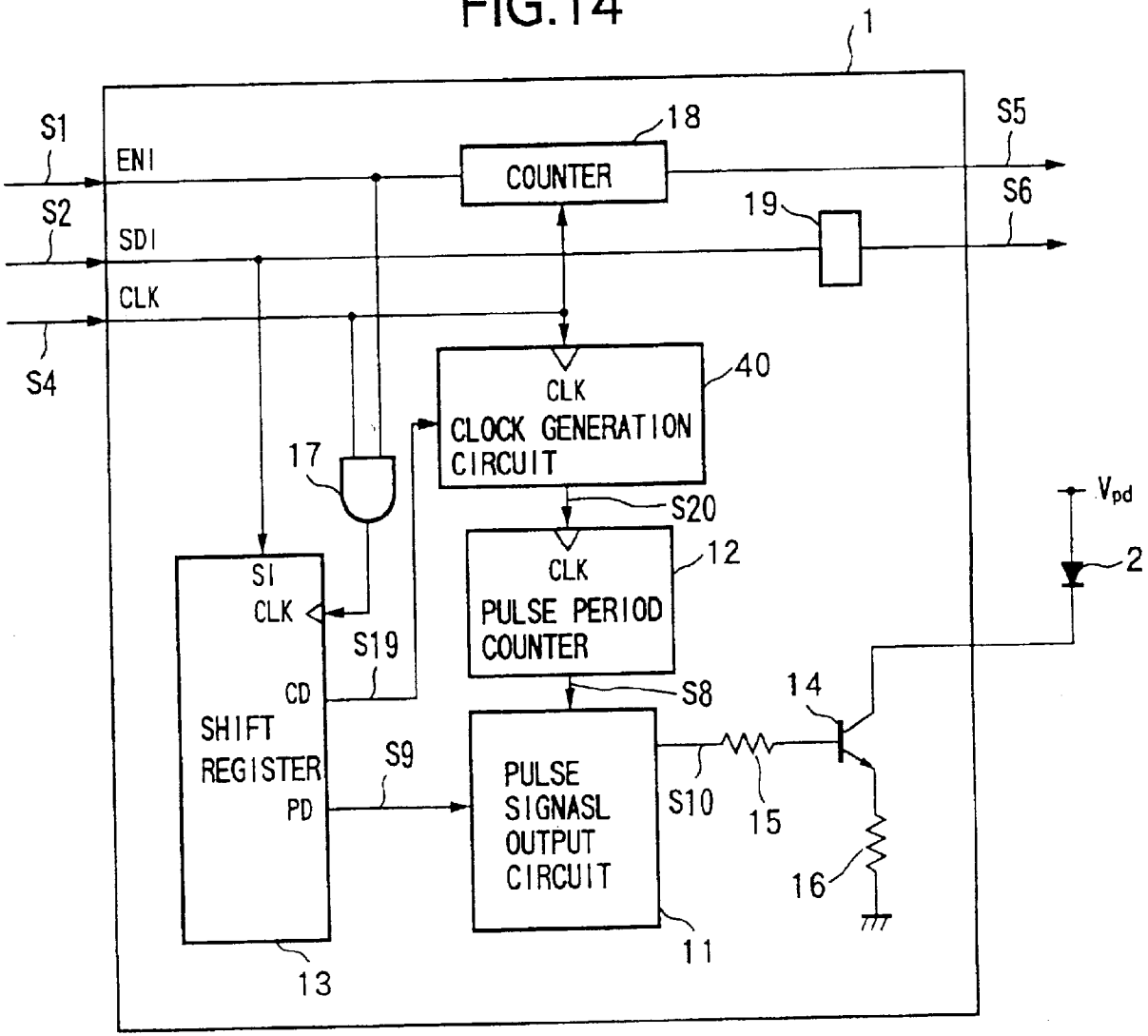
FIG. 14 is a block diagram of a pulse width modulation circuit according to another embodiment of the present invention.

FIG. 14 is a block diagram of the pulse width modulation circuit 1 according to another embodiment of the present invention.

In FIG. 14, 40 denotes a clock generation circuit. Other than this, the same reference numerals as those of FIG. 5 and FIG. 4 indicate the same components.

The clock generation circuit 40 receives the clock signal S4 and clock period data S19 of the shift registers 13, generates a clock signal S20 obtained by dividing or multiplying the clock signal S4 in accordance with the value of the clock period data S19, and outputs the same to the pulse period counter 12.

The pulse period counter 12 receives the clock signal S20 of the clock generation circuit 40, counts the clock signal S20 from the predetermined initial value, and outputs the count S8 thereof to the pulse signal output circuit 11.

The difference of the pulse width modulation circuits 1 of FIG. 5 and FIG. 14 resides in the pulse period signal S3 and the clock generation circuit 40. Namely, the pulse period signal S3 in the pulse width modulation circuit 1 in FIG. 5 is eliminated from the pulse width modulation circuit 1 of FIG. 14, and the clock generation circuit 40 is added in the pulse width modulation circuit 1 of FIG. 14 in place of that.

In the pulse width modulation circuit 1 of FIG. 5, in order to operate all pulse period counters 12 by the common clock signal S4, the pulse period signal S3 for simultaneously resetting all pulse period counters 12 was necessary, but in the pulse width modulation circuit 1 of FIG. 14, the periods of the clocks supplied to the pulse period counters are individually set, therefore it becomes unnecessary to simultaneously reset all pulse period counters 12 and the pulse circuit signal S3 becomes unnecessary.

In this case, a pulse period counter 12 is reset by the input of a high level signal to for example the enable signal S1. Then, if the count of the pulse period counter 12 is restarted at the time when the enable signal S1 changes from a high level to low level, a pulse current of the predetermined pulse length can be smoothly sent through the LED 2, therefore the influence exerted upon the pulse length by the update time of the luminance data can be reduced.

The clock generation circuit 40 is a circuit for supplying a clock signal S20 having a period set with respect to the pulse period counter 12 of each pulse width modulation circuit 1. The clock signal S20 is a signal generated by dividing or multiplying the clock signal S4, and the frequency division number and the multiplication number are set by the clock period data S19.

Note that the period of the clock signal S4 in the present embodiment does not vary along with time such as the clock signal generated by the circuits shown in FIG. 8, FIG. 11, and FIG. 12, but is a period of a constant length.

Figure 15:
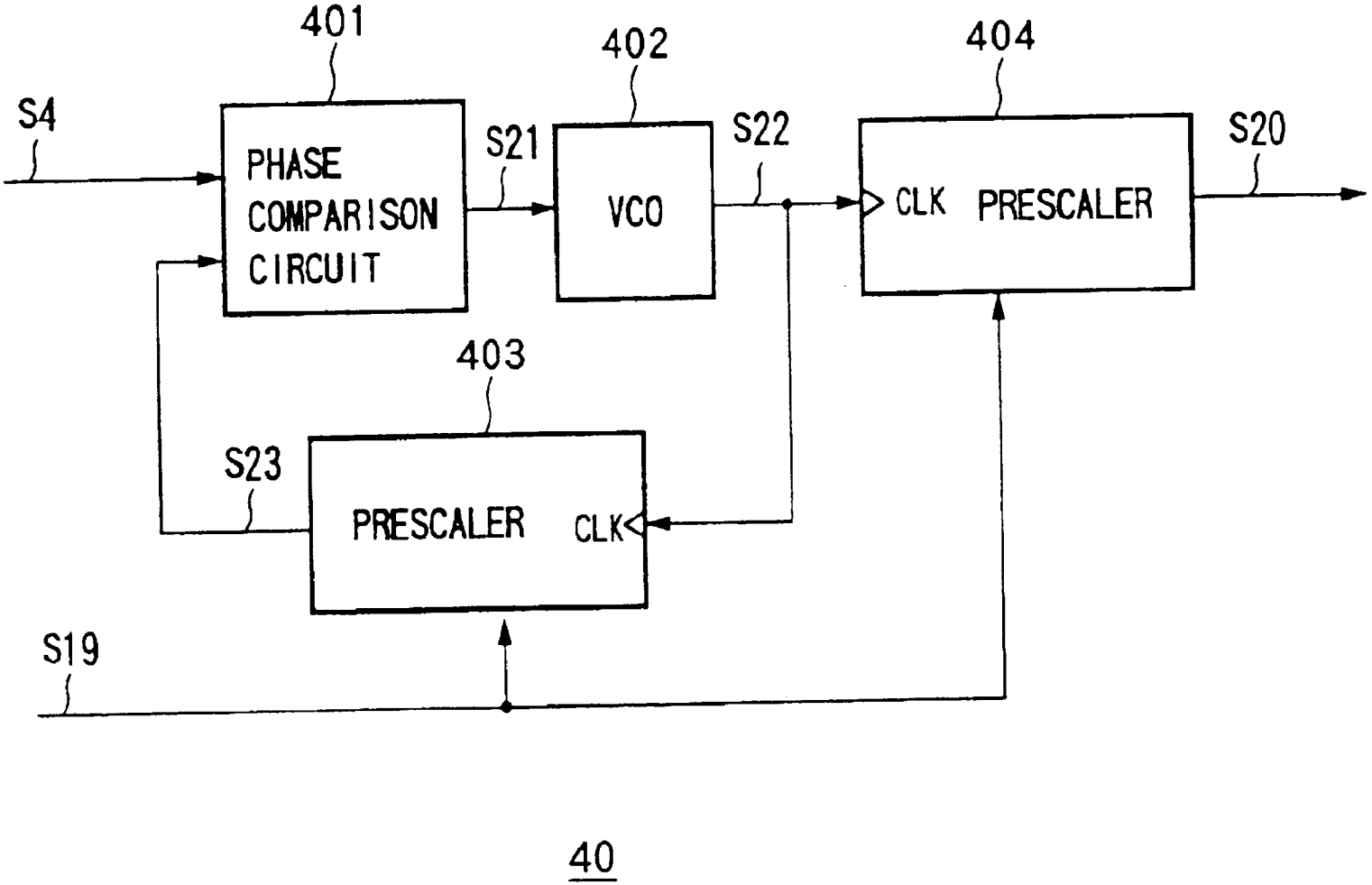
FIG. 15 shows a block diagram of the clock generation circuit possessed by each pulse width modulation circuit according to another embodiment of the present invention.

FIG. 15 is a block diagram of the clock Generation circuit 40 possessed by each pulse width modulation circuit 1 according to another embodiment of the present invention.

In FIG. 15, 401 denotes a phase comparison circuit, 402 a VCO, and 403 and 404 denote prescalers.

The phase comparison circuit 401 detects the phase difference between the clock signal S4 and a feedback signal S23 by the prescaler 403 and outputs a phase difference signal S21 having a level in accordance with the phase difference to the VCO 402.

The VCO 402 outputs a clock signal S22 having a period in accordance with the level of the phase difference signal S21 of the phase comparison circuit 401 to the prescaler 403 and the prescaler 404.

The prescaler 403 receives a clock signal S22 of the VCO 402 and the clock period data S19, divides the clock signal S22 by a frequency division number in accordance with the value of the clock period data S19 to generate the feedback signal S23, and outputs the same to the phase comparison circuit 401.

The prescaler 404 receives the clock signal S22 of the VCO 402 and the clock period data S19, divides the clock signal S22 by a frequency division number in accordance with the value of the clock period data S19 to generate the clock signal S20, and outputs the same to the pulse period counter 12.

The phase comparison circuit 304, VC0 402, and prescaler 403 comprise a general PLL similar to the pulse generation circuit 32 shown in FIG. 11. When the PLL is in the locked state, a clock signal S22 having a frequency whereby the phases of the clock signal S4 and the feedback signal S23 coincide is output from the VCO 402. Also, the period of the feedback signal S23 is set to a length of the frequency division number times with respect to the clock signal S22 of the frequency division number of the prescaler 403. Accordingly, the period of the clock signal S22 is set to the length of one/frequency division number with respect to the clock signal S4.

Further, the period of the clock signal S20 is set to a length of the frequency division number times with respect to the period of the clock signal S22 by the frequency division by the prescaler 404.

Note that, the circuit shown in FIG. 15 is only one example. It is also possible to replace this by another circuit making the clock frequency variable in accordance with the setting. For example, the operation is possible also by a circuit of only the prescaler 404 excluding the PLL circuit comprised of the phase comparison circuit 304, VC0 402, and prescaler 403 and conversely also by only the PLL circuit excluding the prescaler 404.

By providing the clock generation circuits 40 as mentioned above in individual pulse width modulation circuits 1, a pulse current modulated by a clock frequency different for every pulse width modulation circuit 1 can be generated.

In order to correct the luminance characteristic so as to conform to the γ characteristic of the CRT, as mentioned above, the period of the clock may be varied in proportion to the luminance data. In the 8-bit luminance data varying during for example a term from 0 to 255, if the period of the clock signal S20 can be made variable in 255 steps in proportion to the luminance data, the γ characteristic of the CRT can be ideally corrected.

Also, even by setting a plurality of periods in accordance with the range of the luminance data as in the luminance characteristic shown in FIG. 10, the γ characteristic of the CRT can be approximately corrected. In this case, it is necessary to correct the value of the luminance data so as not to cause discontinuity in the luminance at a switch point of the clock periods indicated by the broken line of FIG. 10. For example, when the clock period when the luminance data is 0 to 49 is T and the clock period when the luminance data is 50 to 99 is 2 T, if this luminance data is counted as it is at the pulse period counter 12, the pulse length changes to almost twice its length at the point where the luminance data changes from 49 to 50, so causes a discontinuity in the luminance. Therefore, if the value of the luminance data counted by the pulse period counter 12 when for example the luminance data is 50 to 99 is corrected to a value obtained by subtracting exactly 25 from original luminance data, the discontinuity of the luminance at the point where the luminance data changes from 49 to 50 can be reduced.

In the controller 3, by generating the luminance data corrected as mentioned above and the clock period data and transmitting them to the pulse width modulation circuits 1s, the γ characteristic of the CRT in the luminance characteristic can be corrected.

As explained above, according to the LED display according to the present invention, a clock signal S4 with a frequency varying by a predetermined period is generated and output at the clock generation circuit 32, the clock signal S4 is counted in the pulse period counter 12 from the predetermined initial value in the initial stage of the predetermined period, the magnitudes of the count S8 by the pulse period counter and the value of the luminance data S9 are compared in the pulse signal output circuit 12, and the pulse current flowing through the LED is turned ON or OFF in the vicinity of the time when the magnitudes of the count S8 and the value of the luminance data S9 invert, the relationship between the luminance data and the luminance of the LED can be set matching with the γ characteristic of the CRT without increasing the bit length of the luminance data or applying processing such as correction to the luminance data. Due to this, the scale of the circuit can be kept small, therefore the consumed power can be reduced. Also, it can be cheaply manufactured and the device can be made small in size.

Also, according to a LED display having the clock generation circuit 32 of the first embodiment mentioned above, the frequency division setting signal S12 varying in the value by a predetermined period is generated and output at the frequency division setting circuit 302, and the clock signal S13 of the clock generation circuit 301 is divided by a frequency division number in accordance with the value of the frequency division setting signal S12 and output as the clock signal S4, therefore, by generating a suitable frequency division setting signal S12 at the frequency division setting circuit 302, the relationship between the luminance data and the luminance of the LED can be set matching with the γ characteristic of the CRT without increasing the bit length of the luminance data or applying processing such as correction to the luminance data. Due to this, the scale of the circuit can be kept small, therefore the consumed power can be reduced. Also, it can be cheaply manufactured and the device can be made small in sized.

Also, according to an LED display having the clock generation circuit 32 of the second embodiment mentioned above, a frequency division setting S12 varying in value by a predetermined period is generated and output at the frequency division setting circuit 302, a feedback signal S14 obtained by dividing the clock signal S4 by a frequency division number in accordance with the frequency division setting signal S12 is generated and output at the prescalar 303, the phase difference between the clock signal S13 of the clock generation circuit 301 and the feedback signal S14 is detected, a phase difference signal S15 of a level in accordance with the related phase difference is generated and output at the phase comparison circuit 304, and a clock signal S4 having a frequency in accordance with the level of the phase difference signal S15 is generated and output at the VCO 305. Therefore, by generating a suitable frequency division setting signal S12 at the frequency division setting circuit 302, the relationship between the luminance data and the luminance of the LED can be set matching with the γ characteristic of the CRT without increasing the bit length of the luminance data or applying processing such as correction to the luminance data. By this, the size of the circuit can be kept small, therefore the consumed power can be reduced. Also, it is can be cheaply manufactured and the device can be made small in size.

Also, according to an LED display having a clock generation circuit 32 of the third embodiment mentioned above, a divided signal S17 obtained by the division of the clock signal S4 by a predetermined frequency division number is generated and output at the frequency division circuit 306, a phase difference signal S15 of a level in accordance with the phase difference between a pulse period signal S3 having the above predetermined period and the divided signal S17 is generated and output at the phase comparison circuit S304, a variable clock period signal S18 varying in level by the above predetermined period is generated and output in the variable clock period circuit 308, the added signal S16 obtained by the addition of the variable clock period signal S18 and the phase difference signal S15 is generated and output in the adder circuit 307, and a clock signal S4 having a frequency in accordance with the level of the added signal S16 is generated and output in the VCO 305. Therefore, by generating a suitable variable clock period signal S18 at the variable clock period circuit 308, the relationship between the luminance data and the luminance of the LED can be set matching with the γ characteristic of the CRT without increasing the bit length of the luminance data or applying processing such as correction to the luminance data. By this, the size of the circuit can be kept small, therefore the consumed power can be reduced. Also, it can be cheaply manufactured and the device can be made small in size. Further, the period of the clock signal S4 can be smoothly made variable, therefore the error of the luminance characteristic with respect to the γ characteristic of the CRT can be made small, and the image of the given luminance data can be reproduced more faithfully.

Also, according to an LED display having a pulse width modulation circuit 1 according to another embodiment of the present invention mentioned above, the luminance data S9 and the pulse period data S19 are generated in the controller 3 based on the luminance data generated in the A/D converter 4 and output to each pulse width modulation circuit 1, a clock signal S20 having a frequency in accordance with the pulse period data S19 is generated and output in the clock generation circuit 40, the result obtained by counting the clock signals S20 in the pulse period counter 12 from the predetermined initial value in the initial stage of the above predetermined period is output as the count S8, the magnitudes of the count S8 and the value of the luminance data S9 are compared in the pulse signal output circuit 11, and the pulse current flowing through the LED is turned ON or OFF in the vicinity of the time when the magnitudes of the count S8 and the value of the luminance data S9 are inverted, therefore the relationship between the luminance data and the luminance of the LED can be set matching with the γ characteristic of the CRT without increasing the bit length of the luminance data. By this, the size of the circuit can be kept small, therefore the consumed power can be reduced. Also, it can be cheaply manufactured and the device can be made small in size.

Summarizing the effects of the invention, according to the modulation circuit of the present invention, the relationship between the input data and the pulse length of the pulse signal can be set matching with a predetermined characteristic without increasing the bit length of the input data and without applying processing such as correction to the input data. By this, the size of the circuit can be kept small, therefore the consumed power can be reduced. Also, it can be cheaply manufactured and the device can be made small in size.

According to the LED image display having the modulation circuit of the present invention, the γ characteristic of the CRT can be corrected without increasing the bit length of the luminance data necessary for the modulation of the pulse width. By this, the size of the circuit can be kept small, therefore the consumed power can be reduced. Also, it can be cheaply manufactured and the device can be made small in size.

While the invention has been described with reference to specific embodiment chosen for purpose of illustration, it should be apparent that numerous modifications could be made thereto by those skilled in the art without departing from the basic concept and scope of the invention.

The present disclosure relates to subject matter contained in Japanese Patent Application No. 2000-137159, filed on May 1, 2000, the disclosure of which is expressly incorporated herein by reference in its entirety.

What is claimed is:

1. A modulation circuit for outputting a pulse signal modulated by a predetermined period in accordance with a value of input data, the modulation circuit comprising:

a clock generation circuit for generating and outputting a first clock pulse changing in frequency by said predetermined period;

a clock counting circuit for receiving said first clock pulse, counting said first clock pulse from a predetermined initial value in an initial stage of said predetermined period, and outputting a clock count; and a pulse signal output circuit for comparing magnitudes of said clock count and the value of said input data and inverting a level of said output pulse signal when the magnitudes of said clock count becomes greater than or smaller than the value of said input data.

2. The modulation circuit as set forth in claim 1, wherein said clock pulse generation circuit comprises:

a frequency division setting circuit for outputting a frequency division setting that changes in value by said predetermined period;

a prescaler for receiving a second clock pulse and said frequency division setting, dividing said second clock pulse by a frequency division number in accordance with said frequency division setting, and outputting said first clock pulse.

3. The modulation circuit as set forth in claim 1, wherein said clock pulse generation circuit comprises:

a frequency division setting circuit for outputting a frequency division setting that changes in value by said predetermined period;

a prescaler for receiving said first clock pulse and said frequency division setting, dividing said first clock pulse by a frequency division number in accordance with said frequency division setting, and outputting a feedback signal;

a phase comparison circuit for detecting a phase difference between a second clock pulse and said feedback signal and outputting a phase difference signal in accordance with the related phase difference; and an oscillation circuit for outputting said first clock pulse having a period in accordance with a level of said phase difference signal.

4. The modulation circuit as set forth in claim 1, wherein said clock pulse generation circuit comprises:

a variable clock period circuit for outputting a variable clock period signal that changes in level by the predetermined period;

an oscillation circuit for outputting said first clock pulse having a period in accordance with a level of said variable clock period signal.

5. The modulation circuit as set forth in claim 4, wherein said clock pulse generation circuit further comprises:

a frequency division circuit for dividing said first clock pulse by the predetermined frequency division number and outputting a frequency divided signal; and a phase comparison circuit for detecting a phase difference between a pulse period signal having said predetermined period and said frequency divided signal and outputting a phase difference signal of a level in accordance with the related phase difference; and the oscillation circuit outputs said first clock pulse having a period in accordance with a sum of levels of said variable clock period signal and said phase difference signals.

6. A modulation circuit for outputting a pulse signal modulated in accordance with a value of input data by a predetermined period, the modulation circuit comprising:

a clock generation circuit for generating and outputting a first clock pulse having a frequency in accordance with the value of said input data;

a clock counting circuit for receiving said first clock pulse, counting said first clock pulse from a predetermined initial value in an initial stage of said predetermined period, and outputting a clock count; and a pulse signal output circuit for comparing magnitudes of said clock count and the value of said input data and inverting a level of said pulse when the magnitudes of said clock count becomes greater than or smaller than the value of said input data.

7. The modulation circuit as set forth in claim 6, wherein said clock pulse generation circuit includes a prescaler for receiving a second clock pulse and a value of said input data, dividing said second clock pulse by a frequency division number in accordance with the value of said input data, and outputting said first clock pulse.

8. The modulation circuit as set forth in claim 6, wherein said clock pulse generation circuit comprises a prescaler for receiving said first clock pulse and said input data, dividing said first clock pulse by a frequency division number in accordance with the value of said input data, and outputting a feedback signal;

a phase comparison circuit for detecting a phase difference between a second clock pulse and said feedback signal and outputting a phase difference signal in accordance with the related phase difference; and an oscillation circuit for outputting said first clock pulse having a period in accordance with a level of said phase difference signal.

9. An image display having a light emission element receiving a pulse signal modulated in accordance with a value of input data and emitting light with a luminance in accordance with the level of said pulse signal, the image display comprising:

a clock generation circuit for generating and outputting a first clock pulse changing in frequency by a predetermined period;

a clock counting circuit for receiving said first clock pulse, counting said first clock pulse from a predetermined initial value in an initial stage of said predetermined period, and outputting a clock count; and a pulse signal output circuit for comparing magnitudes of said clock count and the value of said input data and inverting a level of said pulse signal when the magnitudes of said clock count becomes greater than or smaller than the value of said input data.

10. The image display as set forth in claim 9, wherein said clock pulse generation circuit comprises:

a frequency division setting circuit for outputting a frequency division setting changing in value by said predetermined period;

a prescaler for receiving a second clock pulse and said frequency division setting, dividing said second clock pulse by a frequency division number in accordance with said frequency division setting, and outputting said first clock pulse.

11. The image display as set forth in claim 9, wherein said clock pulse generation circuit comprises:

a variable clock period circuit for outputting a variable clock period signal changing in level by the predetermined period; and an oscillation circuit for outputting said first clock pulse having a period in accordance with a level of said variable clock period signal.

12. The image display as set forth in claim 11, wherein said clock pulse generation circuit further comprises:

a frequency division circuit for dividing said first clock pulse by the predetermined frequency division number and outputting a frequency divided signal; and a phase comparison circuit for detecting a phase difference between a pulse period signal having said predetermined period and said frequency divided signal and outputting a phase difference signal of a level in accordance with the related phase difference; and the oscillation circuit outputs said first clock pulse having a period in accordance with a sum of levels of said variable clock period signal and said phase difference signals.

13. An image display having a light emission element receiving a pulse signal modulated in accordance with a value of input data and emitting light with a luminance in accordance with the level of said pulse signal, the image display comprising:

a clock generation circuit for generating and outputting a first clock pulse having a frequency in accordance with the value of said input data;

a clock counting circuit for receiving said first clock pulse, counting said first clock pulse from a predetermined initial value in an initial stage of said predetermined period, and outputting a clock count; and a pulse signal output circuit for comparing magnitudes of said clock count and the value of said input data and inverting a level of said pulse signal in the vicinity of a time when the magnitudes of said clock count becomes greater than or smaller than the value of said input data.

14. The image display as set forth in claim 13, wherein said clock pulse generation circuit further comprises:

a prescaler for receiving a second clock pulse and said input data, dividing said second clock pulse by a frequency division number in accordance with the value of said input data, and outputting said first clock pulse.

15. The image display as set forth in claim 13, wherein said clock pulse generation circuit further comprises:

a prescaler for receiving said first clock pulse and said input data, dividing said first clock pulse by a frequency division number in accordance with the value of said input data, and outputting a feedback signal;

a phase comparison circuit for detecting a phase difference between a second clock pulse and said feedback signal and outputting a phase difference signal in accordance with the related phase difference; and an oscillation circuit for outputting said first clock pulse having a period in accordance with a level of said phase difference signal.

* * * * *